US006408750B1

(12) United States Patent
Goto et al.

(10) Patent No.: US 6,408,750 B1
(45) Date of Patent: Jun. 25, 2002

(54) PRINTER CAPABLE OF CUTTING MARGINS

(75) Inventors: Satoru Goto; Akimasa Kaya, both of Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/602,891

(22) Filed: Jun. 23, 2000

(30) Foreign Application Priority Data

Jun. 23, 1999 (JP) ..... 11-176310
Jul. 16, 1999 (JP) ..... 11-203833
Jul. 19, 1999 (JP) ..... 11-204557

(51) Int. Cl.[7] ..... B26D 5/02

(52) U.S. Cl. ..... 101/226; 101/227; 83/508.1; 83/614; 400/593; 400/621

(58) Field of Search ..... 101/226, 227; 400/593, 621; 83/614, 563, 499, 508.1, 618

(56) References Cited

U.S. PATENT DOCUMENTS 4,207,667 A * 6/1980 D'Angelo ..... 29/417
5,031,498 A * 7/1991 Koppel ..... 83/436
5,097,732 A * 3/1992 Tahara ..... 83/76.001
5,628,864 A * 5/1997 Kataigi et al. ..... 156/441.5
6,012,366 A * 1/2000 Shimizu ..... 83/105
6,131,496 A * 10/2000 Schaede ..... 83/151
6,286,404 B1 * 9/2001 Miglietta ..... 83/498

FOREIGN PATENT DOCUMENTS

JP 8-011087 1/1996 ..... B26D/1/24
JP 2833185 12/1998 ..... B26D/1/24

* cited by examiner

*Primary Examiner*—Andrew H. Hirshfeld
*Assistant Examiner*—Kevin D. Williams
(74) *Attorney, Agent, or Firm*—Sugrue Mion, PLLC

(57) ABSTRACT

A color thermosensitive recording sheet extends two-dimensionally in main and sub scan directions perpendicular to each other. In a thermal printer for use with the recording sheet, two cutters remove front and rear margins from the recording sheet by cutting the recording sheet along lines extending in the main scan direction. Two slitters remove first and second side margins from the recording sheet by slitting the recording sheet along lines extending in the sub scan direction. A slitter shifter shifts the slitters in the main scan direction between a slitting position and home position. The slitters are set at the side margins when in the slitting position, and away from the recording sheet when in the home position. An externally operable mode selector selectively sets a marginless mode and margin mode. A controller causes the slitter shifter to shift the slitters to the slitting position when the marginless mode is set, and actuates the cutters and slitters. The controller causes the slitter shifter to shift the slitters to the home position when the margin mode is set, and disables the cutters and slitters.

21 Claims, 21 Drawing Sheets

PRINTER CAPABLE OF CUTTING MARGINS

BACKGROUND OF THE INVENTION

1. Field of the Invention

The present invention relates to a printer capable of cutting margins. More particularly, the present invention relates to a printer in which a front margin, a rear margin and side margins can be cut away from an image recording region in a print, and in which a space for containing a blade shifting mechanism is saved.

2. Description Related to the Prior Art

A color thermal printer includes one thermal head. A thermosensitive recording sheet is fed in forward and backward directions, while the thermal head records three-color images according to the three-color frame-sequential recording.

The thermal printer includes a feeder constituted by a capstan roller and pinch roller. The feeder nips the recording sheet and rotates to feed the recording sheet in forward and backward directions. While the recording sheet is fed in either of the directions, a thermal head thermally records the image of a particular one of the colors to the recording sheet. To stabilize the thermal recording, an image recording region is defined in the recording sheet with a size smaller than the periphery of the recording sheet for recording of the image. There are margins created about the image recording region. In the field of silver halide photography, it is usual that a print does not have the margins, and that the image recording region is as large as the print. It is conceivable that even the thermal printer produces a print without the margins. However, there is no known thermal printer in which the margins would be cut appropriately away from the image recording region.

To cut away the margins, it is preferable to use a front margin cutter, rear margin cutter and slitter. JP-B 2833185 and JP-A 08-011087 disclose a slitter including upper rotary blades and lower rotary blades, and in which the upper rotary blades is shiftable relative to the lower rotary blades between a slitting position and retracted position.

The slitter according to the prior documents has a shifting mechanism of a pivotally movable type, which shifts the upper rotary blades from the slitting position to the retracted position. There is a shortcoming in that a considerable space is required for swinging the upper rotary blades inside the printer. This space causes the cutting device to have a great thickness, and inconsistent to reducing the size of the cutting device or printer. Also, a problem lies in that ejector rollers must be disposed additionally.

SUMMARY OF THE INVENTION

In view of the foregoing problems, an object of the present invention is to provide a printer capable of cutting margins, in which a space for containing a blade shifting mechanism is saved, and of which a size is relatively small.

In order to achieve the above and other objects and advantages of this invention, a printer is usable with a recording material extending two-dimensionally in a main scan direction and a sub scan direction substantially perpendicular to the main scan direction. At least one cutter removes at least one of front and rear margins from the recording material by cutting the recording material along a line extending in the main scan direction. A slitter removes at least one of first and second side margins from the recording material by slitting the recording material along a line extending in the sub scan direction. A slitter shifter shifts the slitter in the main scan direction between a slitting position and a home position, the slitter being set at the at least one side margin when in the slitting position, and being away from the recording material when in the home position. An externally operable mode selector selectively sets a marginless mode and a margin mode. A controller causes the slitter shifter to shift the slitter to the slitting position when the marginless mode is set, and actuates the cutter and the slitter, the controller causing the slitter shifter to shift the slitter to the home position when the margin mode is set, and for disabling the cutter and the slitter.

Furthermore, a feeder feeds the recording material in the sub scan direction. The cutter is actuated while the feeder is stopped. The slitter is stationary in relation to the sub scan direction, and slits the recording material by actuation of the feeder.

The slitter includes first and second blades arranged in the main scan direction, and have cutting edges directed in the sub scan direction. Third and fourth blades are disposed opposite to respectively the first and second blades with reference to a thickness direction of the recording material, slid by the slitter shifter between the slitting position and the home position, wherein cutting edges of the third and fourth blades, when in the slitting position, are opposed to respectively the cutting edges of the first and second blades in the main scan direction, for slitting the recording material.

The at least one cutter comprises a front margin cutter for cutting away the front margin from the recording material. A rear margin cutter cuts away the rear margin from the recording material.

According to a preferred embodiment, the slitter is disposed downstream from the front and rear margin cutters in the sub scan direction. The slitter and the rear margin cutter are actuated after the front margin cutter is actuated.

Furthermore, an edge sensor is disposed close to the rear margin cutter, for detecting an edge of the rear margin in the recording material. The controller, while the slitter cuts away the at least one side margin, stops the feeder in response to a signal from the edge sensor, actuates the rear margin cutter while the feeder is stopped, and then actuates the feeder to cause the slitter to cut away remainder of the at least one side margin.

The cutter includes a stationary cutter blade having a cutting edge extending in the main scan direction. A movable cutter blade has a cutting edge opposed to the cutting edge of the stationary cutter blade in the sub scan direction. A blade moving mechanism moves the movable cutter blade along the stationary cutter blade.

The movable cutter blade is circular. Furthermore, a blade holder is secured to the blade moving mechanism, for supporting the movable cutter blade in a rotatable manner.

According to a preferred embodiment, a failure detector detects failure in a cutter operation of the cutter. The controller, when failure in the cutter operation is detected, causes the slitter shifter to keep the slitter in the home position.

The blade moving mechanism moves the movable cutter blade from a first position to a second position in the main scan direction, and then moves the movable cutter blade from the second position back to the first position. Furthermore, a position detector detects that the movable cutter blade is in the first position. The failure detector includes a timer for measuring moving time elapsed after the movable cutter blade is initially in the first position and before the movable cutter blade moves back to the first position after movement. The controller compares the moving time with reference time, and detects occurrence of failure if the moving time is longer than the reference time, the reference time being predetermined according to the cutter operation of the movable cutter blade with normality.

The at least one cutter comprises a front margin cutter for cutting away the front margin from the recording material. A rear margin cutter cuts away the rear margin from the recording material. The timer is associated with the movable cutter blade in the front margin cutter.

The blade moving mechanism moves the movable cutter blade from a first position to a second position in the main scan direction, and then moves the movable cutter blade from the second position back to the first position. The failure detector includes an overload detector for monitoring load applied to the movable cutter blade while the blade moving mechanism moves the movable cutter blade toward the second position, and for detecting overload if the load is higher than reference load, the reference load being predetermined according to the cutter operation of the movable cutter blade with normality for the recording material. When the overload is detected, the controller causes the blade moving mechanism to move the movable cutter blade to the first position.

The blade moving mechanism includes a cutter motor, controlled by the controller, for rotating forwards and then backwards, to move the movable cutter blade. The overload detector monitors load to the cutter motor while the cutter motor rotates forwards. When the overload is detected, the controller forcibly causes the cutter motor to rotate backwards.

According to a preferred embodiment, the feeder includes at least first and second feed rollers for nipping the recording material and for feeding thereof in the sub scan direction. First and second support shafts extend in the main scan direction, for supporting and rotating the first and second feed rollers. The first and second blades are circular and secured to the first support shaft, and the third and fourth blades are circular and secured to the second support shaft.

Furthermore, a shock absorber absorbs shock received by the third and fourth blades from the first and second blades when the slitter shifter causes the third and fourth blades to contact the first and second blades in the slitting position.

The third and fourth blades are disposed above the first and second blades.

The slitter shifter includes a shifter motor. First and second support mechanisms support respectively the third and fourth blades on the second support shaft in a slidable manner. A cam mechanism is shifted by the shifter motor between first and second shifted positions, for driving the first and second support mechanisms, wherein the cam mechanism, when in the first shifted position, shifts the third and fourth blades to the slitting position, and when in the second shifted position, shifts the third and fourth blades to the home position.

Each of the first and second support mechanisms includes a support sleeve, secured to the second support shaft in a slidable manner, and having the third or fourth blade secured thereto. A sliding sleeve is secured to the second support shaft in a slidable manner between an axial end of the second support shaft and the support sleeve. The shock absorber is a coil spring, disposed between the support sleeve and the sliding sleeve, for receiving insertion of the second support shaft.

Each of the first and second support mechanisms further includes a holder plate, disposed between the axial end of the second support shaft and the sliding sleeve, for receiving insertion of the second support shaft in a rotatable manner, the holder plate being slidable with reference to the second support shaft, for preventing the support sleeve and the sliding sleeve from dropping away from the second support shaft. A support bracket is secured to the holder plate, and extending substantially along the second support shaft. A cam follower pin projects from the support bracket, and is driven by the cam mechanism. A rectilinear guiding mechanism guides movement of the cam follower pin in the main scan direction.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
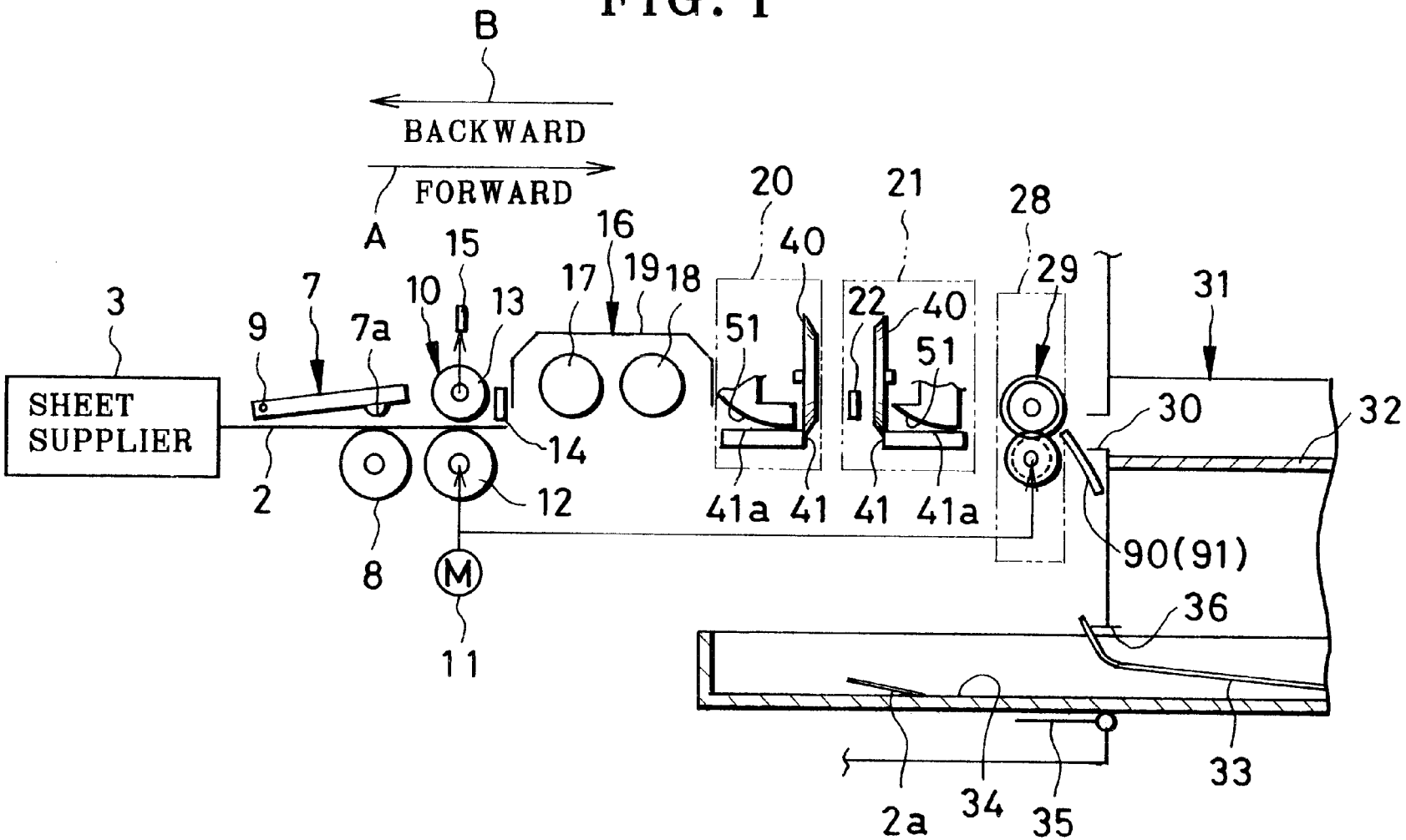
FIG. 1 is an explanatory view in elevation, illustrating a thermal printer.

In FIG. 1, a color thermal printer is depicted. The thermal printer is used with color thermosensitive recording sheets 2 as recording material. A sheet supplier 3 contains the recording sheets 2 in a stack, and has a supply roller for supplying a body of the printer with the recording sheets 2.

A thermal head 7 and platen drum 8 are disposed downstream from the sheet supplier 3. A heating element array 7*a* is included in the thermal head 7, and has a great number of heating elements arranged in a line. A pivot 9 is a center about which the thermal head 7 is pivotally moved between a printing position and retracted position. The thermal head 7 presses the recording sheet 2 on the platen drum 8 when in the printing position, and comes away from the platen drum 8 when in the retracted position.

The recording sheet 2 includes a support, on which cyan, magenta and yellow coloring layers are overlaid as is well-known in the art. The yellow coloring layer is the farthest from the support, and has the highest heat sensitivity. The yellow coloring layer develops the yellow color by application of relatively low heat energy. The cyan coloring layer is the closest to the support, and has the lowest heat sensitivity. The cyan coloring layer develops the cyan color by application of relatively high heat energy. The yellow coloring layer loses its coloring ability when visible violet rays of 420 nm are applied to it. The magenta coloring layer develops the magenta color by application of medium heat energy, and loses its coloring ability when ultraviolet rays of 356 nm are applied to it. Note that it is possible to overlay a black thermosensitive coloring layer on the recording sheet 2 as a fourth coloring layer.

A sheet feeder 10 is disposed in a position downstream from the thermal head 7 for feeding the recording sheet 2. The sheet feeder 10 is constituted by a capstan roller 12 and pinch roller 13 disposed above the capstan roller 12. A stepping motor 11 drives the capstan roller 12 disposed under the recording sheet 2. The pinch roller 13 is movable between positions on and away from the capstan roller 12. When a position sensor 14 detects a front end of the recording sheet 2, the sheet feeder 10 squeezes the recording sheet 2 by pressure of the pinch roller 13. The capstan roller 12 rotates to transport the recording sheet 2 in a sub scan direction, or either one of a forward direction A and a backward direction B that is reverse to the sheet supply or the forward direction A.

A rotary encoder 15 is connected to a rotary shaft of the pinch roller 13. The rotary encoder 15 counts the number of rotations of the pinch roller 13, to measure an amount at which the recording sheet 2 is fed.

An optical fixer 16 is disposed downstream from the sheet feeder 10. The fixer 16 includes a yellow fixer lamp 17, magenta fixer lamp 18 and reflector 19. The yellow fixer lamp 17 emits visible violet rays of which the wavelength peaks at 420 nm. The magenta fixer lamp 18 emits ultraviolet rays of which the wavelength peaks at 365 nm. The reflector 19 covers the rear of the fixer lamps 17 and 18.

A front margin cutter 20 and rear margin cutter 21 are disposed downstream from the fixer 16 with reference to the forward direction. The front margin cutter 20 cuts the recording sheet 2 along a cutting line 2*a* in a main scan direction, to cut away a front margin 2*b,* which is defined between a recording region and front edge of the recording sheet 2 disposed downstream in the forward direction. The rear margin cutter 21 cuts the recording sheet 2 along a cutting line in the main scan direction, to cut away a rear margin 2*c,* which is defined between the recording region and a rear edge of the recording sheet 2 disposed upstream in the forward direction. See FIGS. 2–4 for the cutting line 2*a* and the front and rear margins 2*b* and 2*c*.

A slitter 28 is disposed downstream from the rear margin cutter 21 in the sub scan direction. A sheet feeder 29 or ejector is incorporated in the slitter 28. The sheet feeder 29 is driven by the stepping motor 11, nips the recording sheet 2 and feeds it in the forward direction. The slitter 28 cuts the recording sheet 2 along slitting lines in the sub scan direction during the feeding by the sheet feeder 29, to remove right and left side margins 33 at the same time from an image recording region.

An exit 30 is located downstream from the slitter 28 in the forward direction. A receptacle unit 31 is secured to a wall outside the exit 30 in a removable manner. The receptacle unit 31 includes a sheet receptacle 32 and dust receptacle 34. The sheet receptacle 32 receives the recording sheet 2 ejected from the exit 30. The dust receptacle 34 is disposed under the front and rear margin cutters 20 and 21 and slitter 28, and receives the side margins 33 from the slitter 28. The dust receptacle 34 protrudes down from a lower side of the sheet receptacle 32. In the printer, a door 35 is openably disposed under the exit 30. The dust receptacle 34, in the loading of the receptacle unit 31, pushes the door 35 and enter an insertion slot 36 to be set in the printer. When the receptacle unit 31 is removed from the printer, a spring (not shown) biases the door 35 to close the insertion slot 36.

Note that a dust amount detecting sensor is preferably disposed in the dust receptacle 34 although not shown in the drawing. When the side margins 33 increase to come up to an upper limit amount, the dust amount detecting sensor emits an alarm signal. This is effective in preventing the side margins 33 from causing jamming of the recording sheets.

Figure 2:
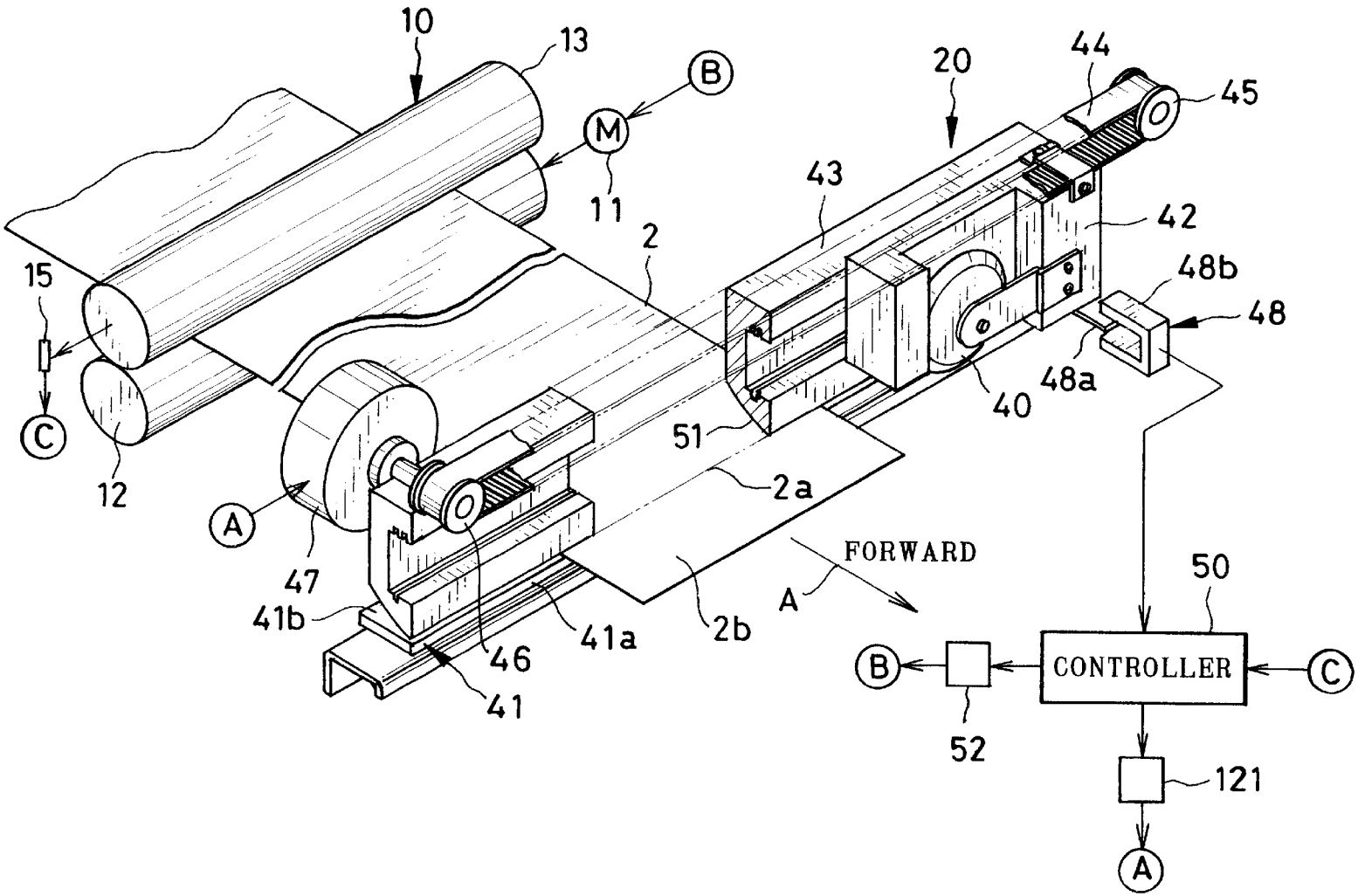
FIG. 2 is a perspective illustrating a front margin cutter in the thermal printer.

In FIG. 2, the front margin cutter 20 includes a movable cutter blade 40, stationary cutter blade 41, blade holder 42, blade holder rail 43 and position detector 48. The stationary cutter blade 41 has a thin plate shape, and extended in the main scan direction. A cutting edge 41*a* of the stationary cutter blade 41 is constituted by its upper longer side line. The cutting edge 41*a* is located slightly lower than the feeding path. The movable cutter blade 40 is mounted in the blade holder 42 in a rotatable manner, and contacts the cutting edge 41*a* of the stationary cutter blade 41. The blade holder rail 43 supports the blade holder 42 in a movable manner in the main scan direction of the recording sheet 2. A portion of a blade moving belt 44 is secured to the blade holder 42.

A pair of pulleys 45 and 46 are engaged with the blade moving belt 44, and disposed in the main scan direction of the recording sheet 2. A cutter motor 47 drives the pulley 46. The blade moving belt 44 is moved round by the pulley 46 in forward and backward directions upon rotation of the cutter motor 47. The blade holder 42 is moved back and forth in the main scan direction of the recording sheet 2. The position detector 48 is constituted by an interception plate 48*a* and photoelectric sensor 48*b*. The interception plate 48*a* is secured to the blade holder 42. The photoelectric sensor 48*b* is a transmission type, and detects the interception plate 48*a* when a sensor beam in the photoelectric sensor 48*b* is intercepted by the interception plate 48*a*. Upon the detection, the photoelectric sensor 48*b* sends a sensor signal to a controller 50 to inform it that the blade holder 42 has returned to the home position.

The controller 50 sets the cutting line in the recording sheet 2 according to the counted number of rotations of the pinch roller 13, and controls the stepping motor 11 and cutter motor 47 by means of respectively motor drivers 52 and 121 to stop the recording sheet 2 before the cutting operation.

Figure 3:
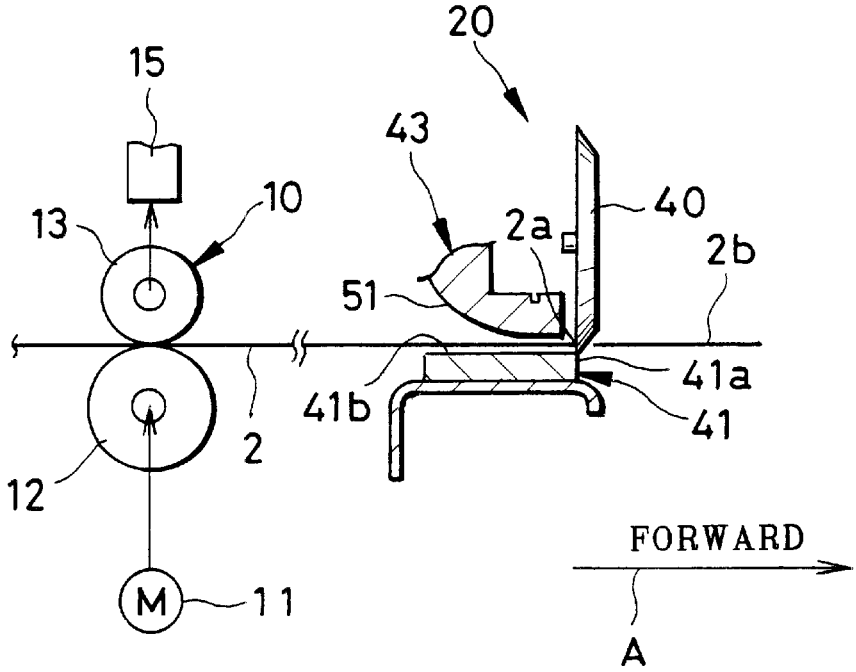
FIG. 3 is an explanatory view in section, illustrating the front margin cutter.

The stationary cutter blade 41 includes an upper surface 41*b* that is parallel to a feeding path. A sheet guide face 51 is a lower surface of the blade holder rail 43. As illustrated in FIG. 3, the sheet guide face 51 has a shape of which its distance to the upper surface 41*b* of the stationary cutter blade 41 decreases gradually. So the sheet guide face 51 guides the recording sheet 2 toward the cutting edge 41*a*.

Figure 4:
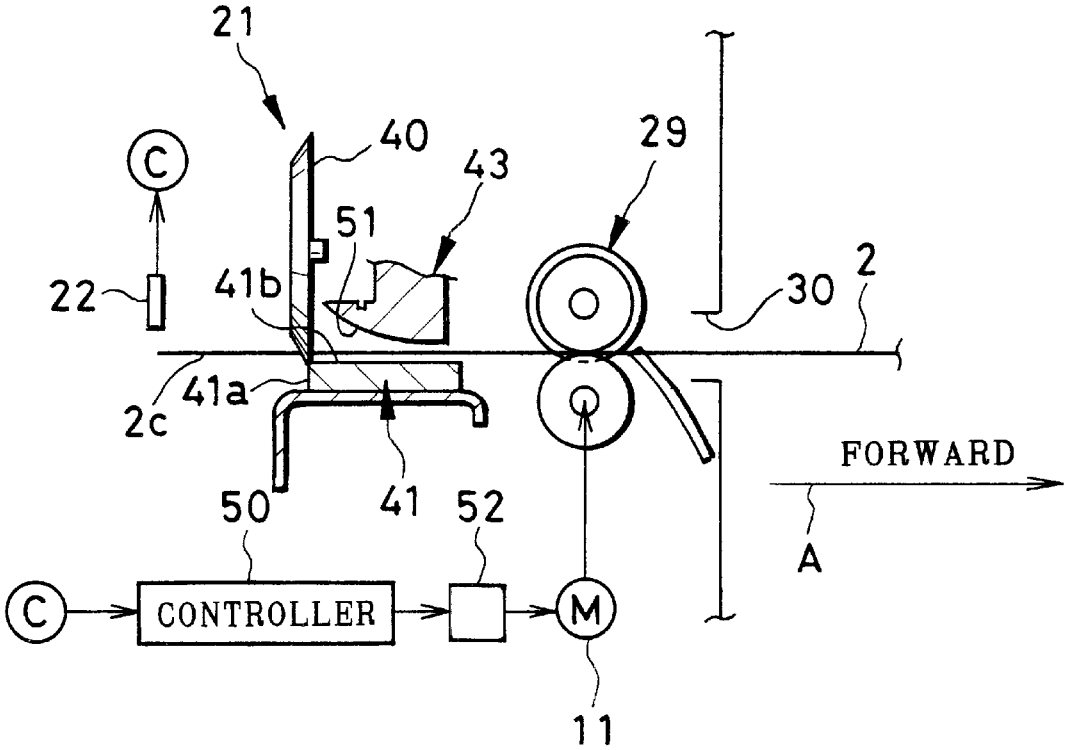
FIG. 4 is an explanatory view in section, illustrating a rear margin cutter.

The rear margin cutter 21 has basically the same construction as the front margin cutter 20. Elements in the rear margin cutter 21 similar to those in the front margin cutter 20 are designated with identical reference numerals. One of the differences of the rear margin cutter 21 is that the movable cutter blade 40 and stationary cutter blade 41 are arranged in reverse with reference to the forward direction. See FIG. 1. In FIG. 4, the sheet guide face 51 for the rear margin cutter 21 is constituted by a lower surface of the blade holder rail 43, and defines a space increasing in a direction toward the cutting edge 41*a*. The rear margin cutter 21 is actuated after the front margin cutter 20 is actuated, and cuts the rear margin 2*c* in the recording sheet 2 while the rear margin 2*c* is nipped by the sheet feeder 29.

An edge sensor 22 is disposed upstream from the movable cutter blade 40 in the rear margin cutter 21, and detects a rear edge of the recording sheet 2. Upon the detection of the edge sensor 22, a cutting line for the rear margin 2*c* of the recording sheet 2 is set at a cutting position of the rear margin cutter 21. According to the detection signal from the edge sensor 22, the controller 50 stops feeding of the recording sheet 2. For the cutting operation, the controller 50 controls the stepping motor 11 and the cutter motor 47 for the rear margin cutter 21.

Figure 5:
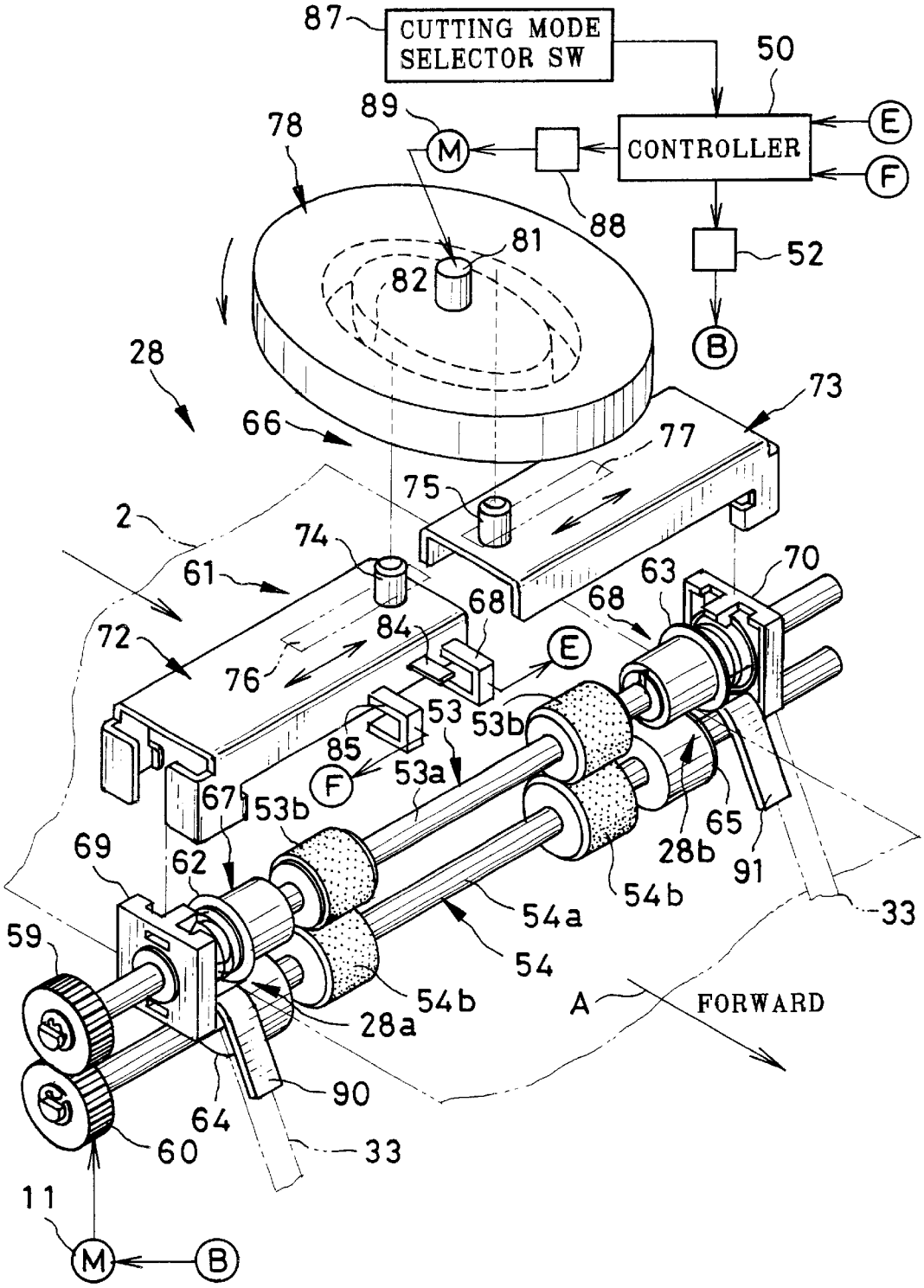
FIG. 5 is an exploded perspective illustrating a slitter in the thermal printer for cutting away side margins.
Figure 6:
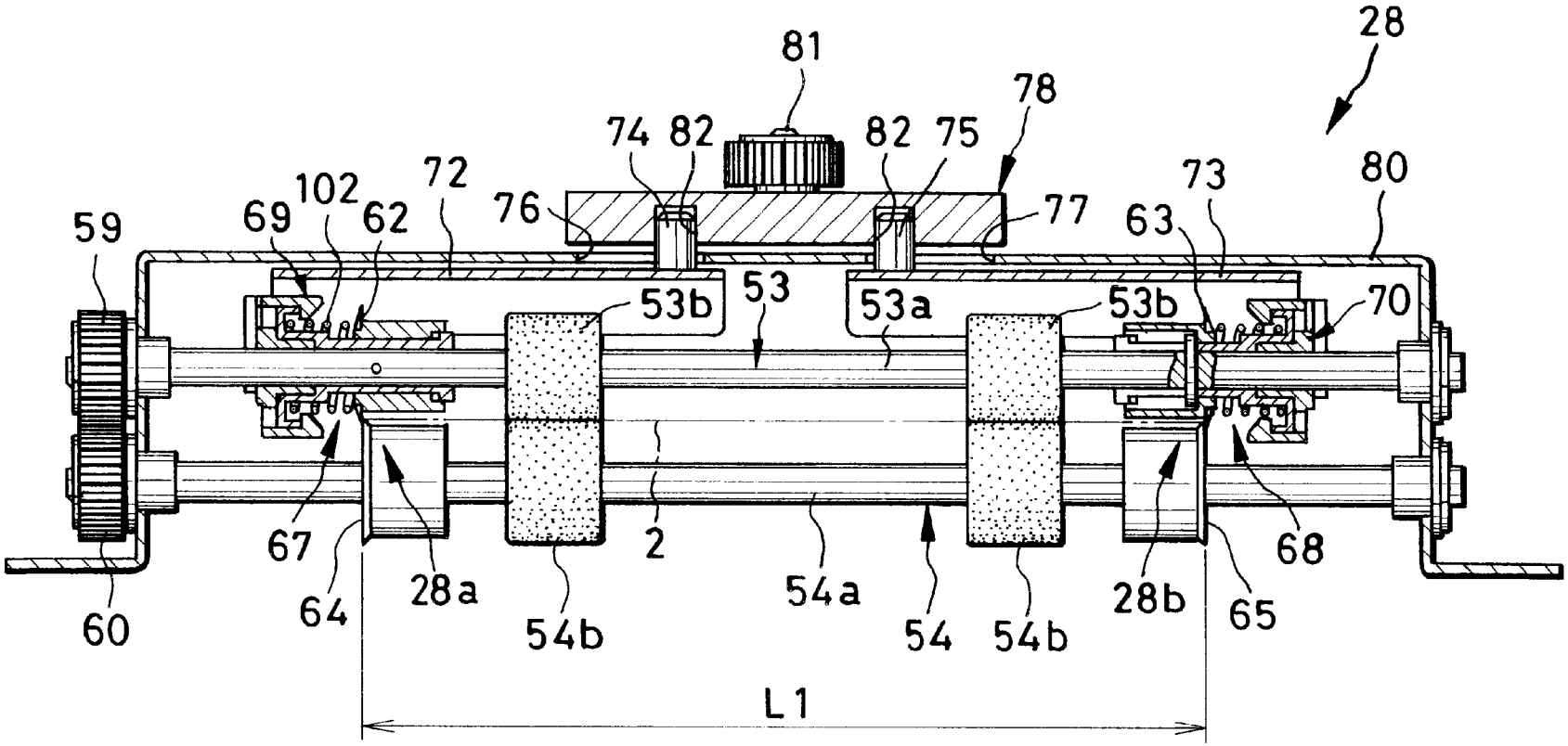
FIG. 6 is an explanatory view in section, illustrating a state of the slitter in which second and fourth blades are shifted to first and third blades.
Figure 7:
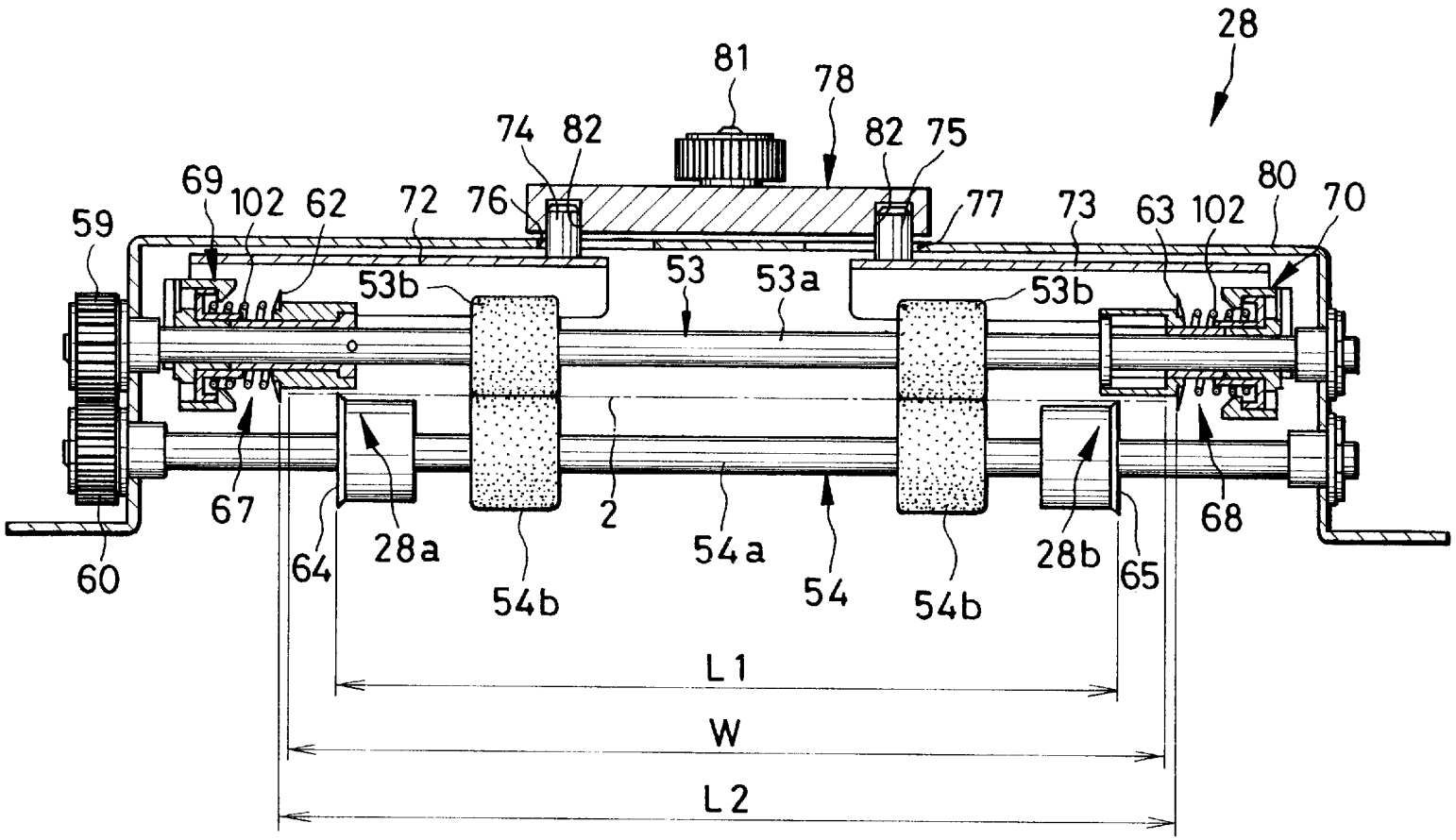
FIG. 7 is an explanatory view in section, illustrating a state in which second and fourth blades are shifted away from first and third blades.

In FIGS. 5–7, the slitter 28 is constituted by the sheet feeder 29, a pair of slitter mechanisms 28*a* and 28*b* and a slitter shifter 66. The slitter mechanisms 28*a* and 28*b* cut side margins from the recording sheet 2 along slitting lines in the sub scan direction. The slitter shifter 66 shifts the slitter mechanisms 28*a* and 28*b* in the main scan direction of the recording sheet 2. The slitter mechanisms 28*a* and 28*b* are shiftable between a slitting position and home position, the slitting position being for slitting operation of the recording sheet 2, the home position being defined not to block feeding of the recording sheet 2. The sheet feeder 29 is constituted by an upper roller group 53 and lower roller group 54 for nipping the recording sheet 2 and for feeding the recording sheet 2 toward the exit 30. The upper roller group 53 includes an upper support shaft 53*a* and upper feed rollers 53*b*. The upper support shaft 53*a* extends in the main scan direction of the recording sheet 2. The upper feed rollers 53*b* are fixed to the upper support shaft 53*a* and arranged at a predetermined distance.

The lower roller group 54 includes a lower support shaft 54*a* and lower feed rollers 54*b*. The lower support shaft 54*a* extends in the main scan direction of the recording sheet 2. The lower feed rollers 54*b* are fixedly secured to the lower support shaft 54*a* for contacting the upper feed rollers 53*b*. Gears 59 and 60 are fixed to ends of the support shafts 53*a* and 54*a*, and meshed with each other. The stepping motor 11 drives the gear 59 for the gears 59 and 60 to rotate the support shafts 53*a* and 54*a*.

The slitter mechanism 28*b* includes a first rotary blade 64 and third rotary blade 65. The slitter mechanism 28*a* includes a second rotary blade 62 and fourth rotary blade 63. The first and third rotary blades 64 and 65 are concentrical with the lower support shaft 54*a*, and fixed to positions between an axial end of the lower support shaft 54*a* and each of the lower feed rollers 54*b*. In FIG. 6, let L1 be a distance between cutting edges of the first and third rotary blades 64 and 65. The distance L1 is equal to or slightly smaller than a predetermined width of a recording region in the main scan direction. Also, the cutting edges of the first and third rotary blades 64 and 65 have a diameter equal to that of the lower feed rollers 54*b*.

The second and fourth rotary blades 62 and 63 are shifted by the slitter shifter 66 in the main scan direction of the recording sheet 2 between the slitting position and home position. The second and fourth rotary blades 62 and 63, when in the slitting position, contact the first and third rotary blades 64 and 65, and when in the home position, come away from those in the main scan direction of the recording sheet 2. The slitter shifter 66 includes first and second blade support mechanisms 67 and 68, holder plates 69 and 70 and a shifter unit 61. The shifter unit 61 shifts the holder plates 69 and 70 in a linked manner.

The second and fourth rotary blades 62 and 63 are secured to the first and second blade support mechanisms 67 and 68. The holder plates 69 and 70 support the first and second blade support mechanisms 67 and 68 in a manner slidable along an axis of the upper support shaft 53*a* and rotatable together with the upper support shaft 53*a*.

The shifter unit 61 includes support brackets 72 and 73, cam follower pins 74 and 75, a cam plate 78, and a shifter motor 89, the cam follower pins 74 and 75 and the cam plate 78 being included in a cam mechanism. The support bracket 72 has one end for supporting the holder plate 69, and the remaining end having the cam follower pin 74. The support bracket 73 has one end for supporting the holder plate 70, and the remaining end having the cam follower pin 75. A pair of rectilinear guiding slots 76 and 77 are formed in a cutter chassis 80, and guide the cam follower pins 74 and 75 in the main scan direction of the recording sheet 2. The cutter chassis 80 supports ends of the support shafts 53*a* and 54*a* in a rotatable manner.

The cam plate 78 has an elliptic shape, and rotatable about a shaft 81. A cam groove 82 is formed in the cam plate 78 and has an elliptic shape. The cam follower pins 74 and 75 are engaged with cam surfaces in the cam groove 82. When the cam plate 78 rotates, the cam follower pins 74 and 75 are shifted with the support brackets 72 and 73 in the main scan direction of the recording sheet 2. The support brackets 72 and 73 are secured to the holder plates 69 and 70. The second and fourth rotary blades 62 and 63 are shifted between the slitting position and home position.

In the home position, a distance L2 between cutting edges of the second and fourth rotary blades 62 and 63 is greater than a width W of the recording sheet 2. The cam groove 82 has such a shape that rotation of the cam plate 78 by 90 degrees sets the second and fourth rotary blades 62 and 63 between the slitting position and home position alternately.

In the slitter 28, there are position sensors 85 and 86 for detecting positions of the holder plates 69 and 70. The position sensors 85 and 86 are photoelectric sensors of a transmission type, and detect an interception plate 84 secured to the support bracket 72 to block light. When the position sensor 86 detects the interception plate 84, the position sensor 86 sends the controller 50 a signal of information that the second and fourth rotary blades 62 and 63 have come to the slitting position. When the position sensor 85 detects the interception plate 84, the position sensor 85 sends the controller 50 a signal of information that the second and fourth rotary blades 62 and 63 have come to the home position.

A cutting mode selector switch 87 is connected to the controller 50 in an externally operable manner. Mode signals for a margin mode and marginless mode is input by the cutting mode selector switch 87 to the controller 50. When the marginless mode is set by means of the cutting mode selector switch 87, a motor driver 88 is supplied by the controller 50 with a motor driving signal, to drive the shifter motor 89 for rotation of the cam plate 78 in one direction. While the shifter motor 89 is driven, the controller 50 monitors detection signals from the position sensors 85 and 86, and stops the shifter motor 89 when a signal is generated from the position sensor 86.

Separator plates 90 and 91 are formed with the holder plates 69 and 70. The separator plates 90 and 91 separate the side margins 33 from the recording sheet 2 after being cut away by the slitter mechanisms 28*a* and 28*b,* and guide those to the dust receptacle 34. When the second and fourth rotary blades 62 and 63 are shifted to the slitting position, the separator plates 90 and 91 are positioned downstream from the second and fourth rotary blades 62 and 63 in the forward direction. When the second and fourth rotary blades 62 and 63 are shifted to the home position, the separator plates 90 and 91 are shifted to positions not to block feeding of the recording sheet 2.

Note that the second blade support mechanism 68 is structurally the same as the first blade support mechanism 67. The holder plate 70 is the same as the holder plate 69. So only the first blade support mechanism 67 and holder plate 69 will be basically described hereinafter. Elements in the second blade support mechanism 68 and holder plate 70 similar to those in the first blade support mechanism 67 and holder plate 69 are designated with identical reference numerals.

Figure 8:
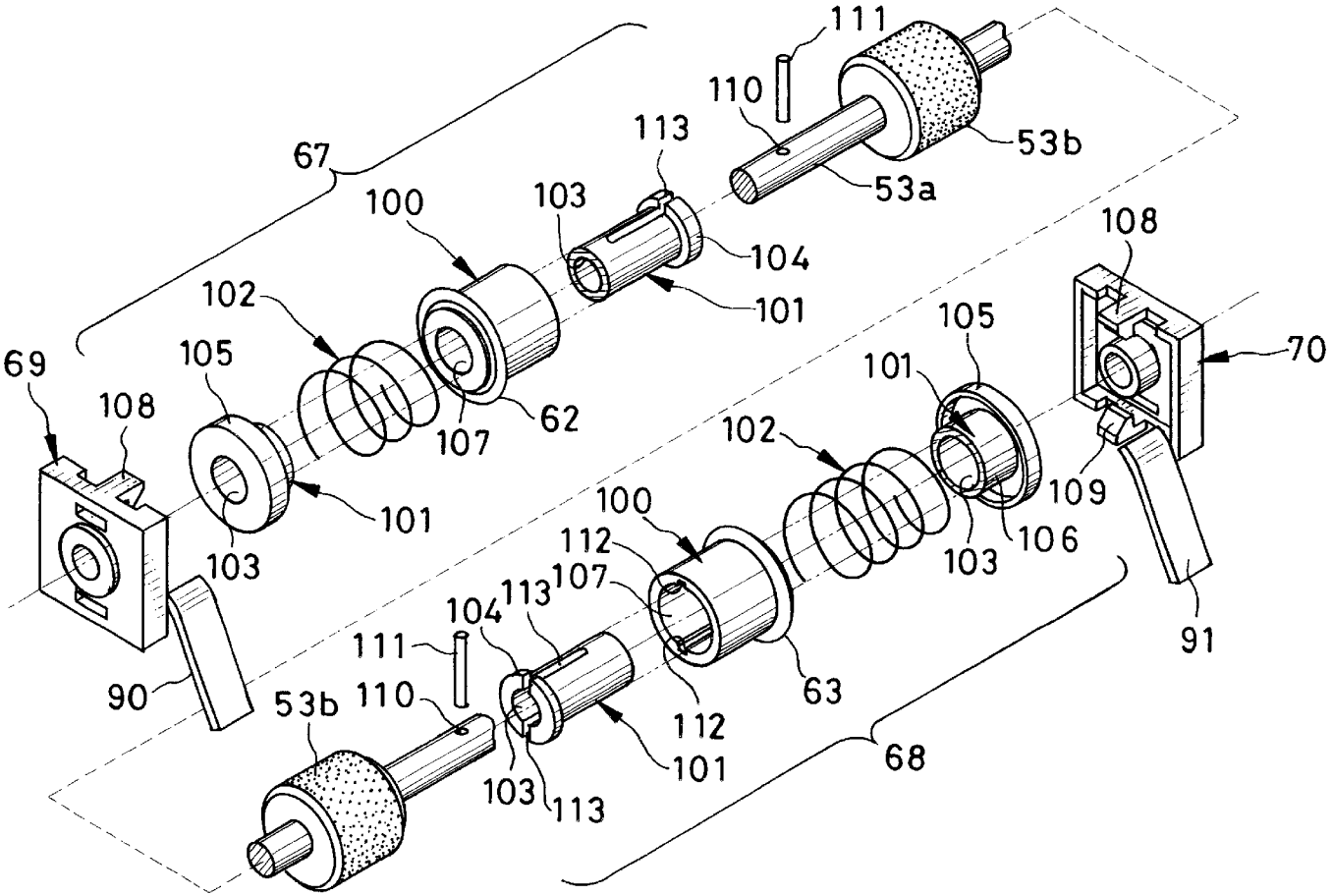
FIG. 8 is a perspective illustrating a support shaft, feed rollers, and various elements combined with the second and fourth blades.
Figure 9:
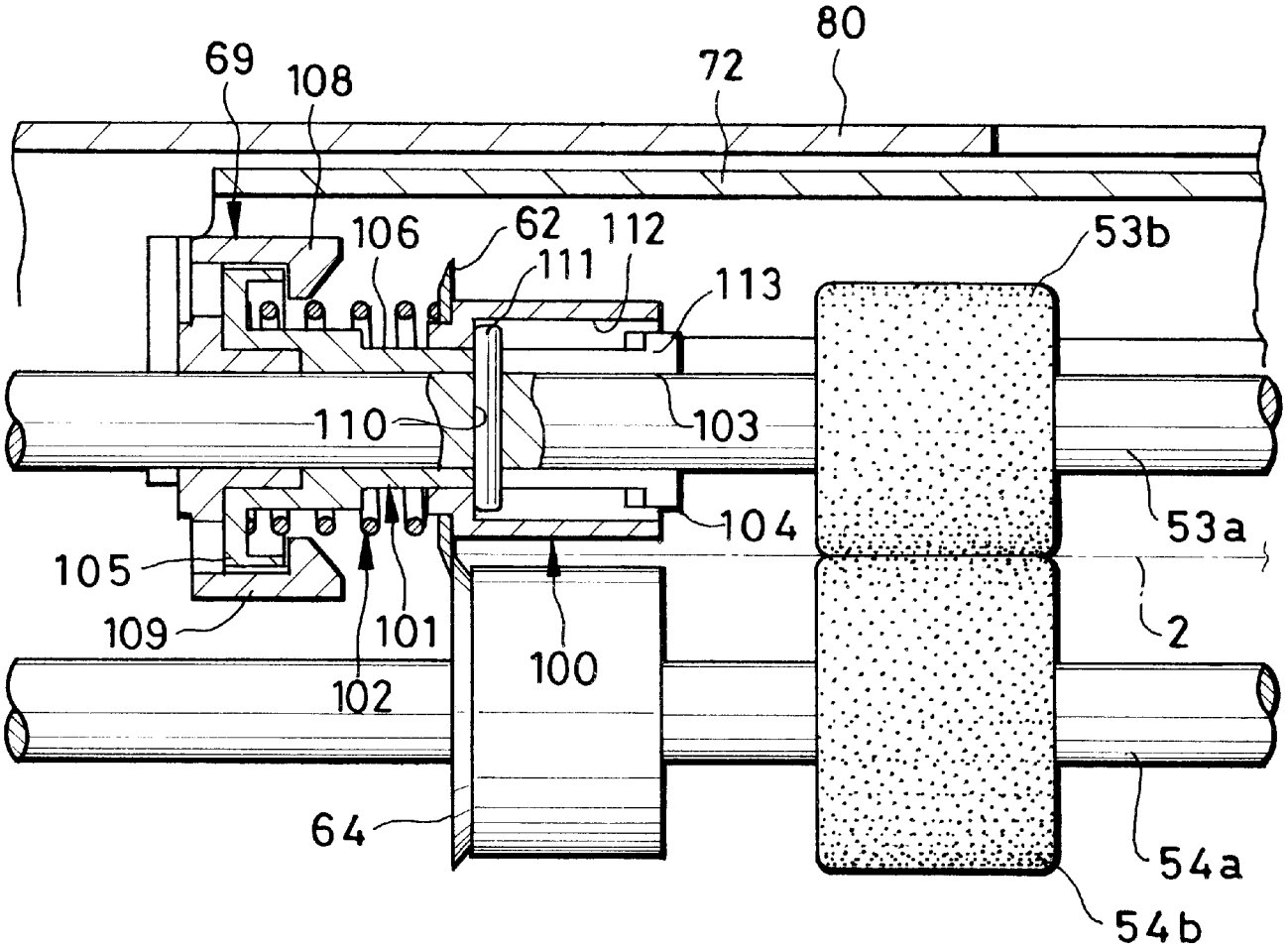
FIG. 9 is an explanatory view in enlargement, illustrating the slitter in which shiftable second and fourth blades are shifted to the first and third blades.

In FIGS. 8 and 9, the first blade support mechanism 67 is constituted by a support sleeve 100, sliding sleeve 101 and shock absorbing coil spring 102. The support sleeve 100 supports the second rotary blade 62. The sliding sleeve 101 is tubular, and supported by the upper support shaft 53*a* in an axially movable manner. The sliding sleeve 101 is provided with a guide groove 103 and stopper flanges 104 and 105. A peripheral surface between the stopper flanges 104 and 105 supports the support sleeve 100 in a slidable manner.

The shock absorbing coil spring 102 is inserted between the stopper flange 105 and support sleeve 100, and biases the support sleeve 100 toward the stopper flange 104. Thus, shock in the contact of the second rotary blade 62 with the first rotary blade 64 can be absorbed while the second rotary blade 62 is biased in movement toward the slitting position. Also, force of pressing the second rotary blade 62 against the first rotary blade 64 can be kept constant.

Resilient hooks 108 and 109 are formed with edges of the holder plate 69 so that the upper support shaft 53*a* is located between those. The hooks 108 and 109 keep the stopper flange 105 rotatable about an axis of the upper support shaft 53*a* and also keep the stopper flange 105 from moving in the axial direction of the upper support shaft 53*a*.

It is to be noted that a washer may be used without the use of the sliding sleeve 101, and may be inserted between the end of the shock absorbing coil spring 102 and the inside of the holder plates 69 and 70 instead of the stopper flange 105.

A through hole 110 is formed in the upper support shaft 53*a*. A pin 111 is inserted in the through hole 110 in such a manner that its ends protrude from the upper support shaft 53*a* for transmission of rotary force to the support sleeve 100 and sliding sleeve 101. Guide grooves 112 are formed in an inner surface 107 of the support sleeve 100, extend in the axial direction, and are engaged with ends of the pin 111. Also, guide slots 113 are formed in the sliding sleeve 101 for insertion of ends of the pin 111. The guide grooves 112 and guide slots 113 have lengths determined according to a shift of the first blade support mechanism 67 in the axial direction of the upper support shaft 53*a*.

In the printer of the invention, the front margin cutter 20 cuts the front margin 2*b* at first after the image recording operation. However, jamming of the recording sheet 2 is likely to occur due to a stop of the movable cutter blade 40 in the middle of the recording sheet 2, typically when two or more recording sheets 2 are fed in an overlapped manner or when a cutting edge of the movable cutter blade 40 is partially broken. Widely used printers are provided with a troubleshooting openable door through which a user inserts his or her hand to remove the jammed recording sheets 2. However, the printer according to the present embodiment includes the blades of the cutter and slitter. There is a danger if an openable door is used for insertion of a hand. Accordingly, the controller 50 is provided with a safety circuit for a control of stopping a cutting or slitting operation if a difficulty occurs in an initial cutting operation, returning the blades to the initial position, and ejecting the recording sheet 2.

Figure 10:
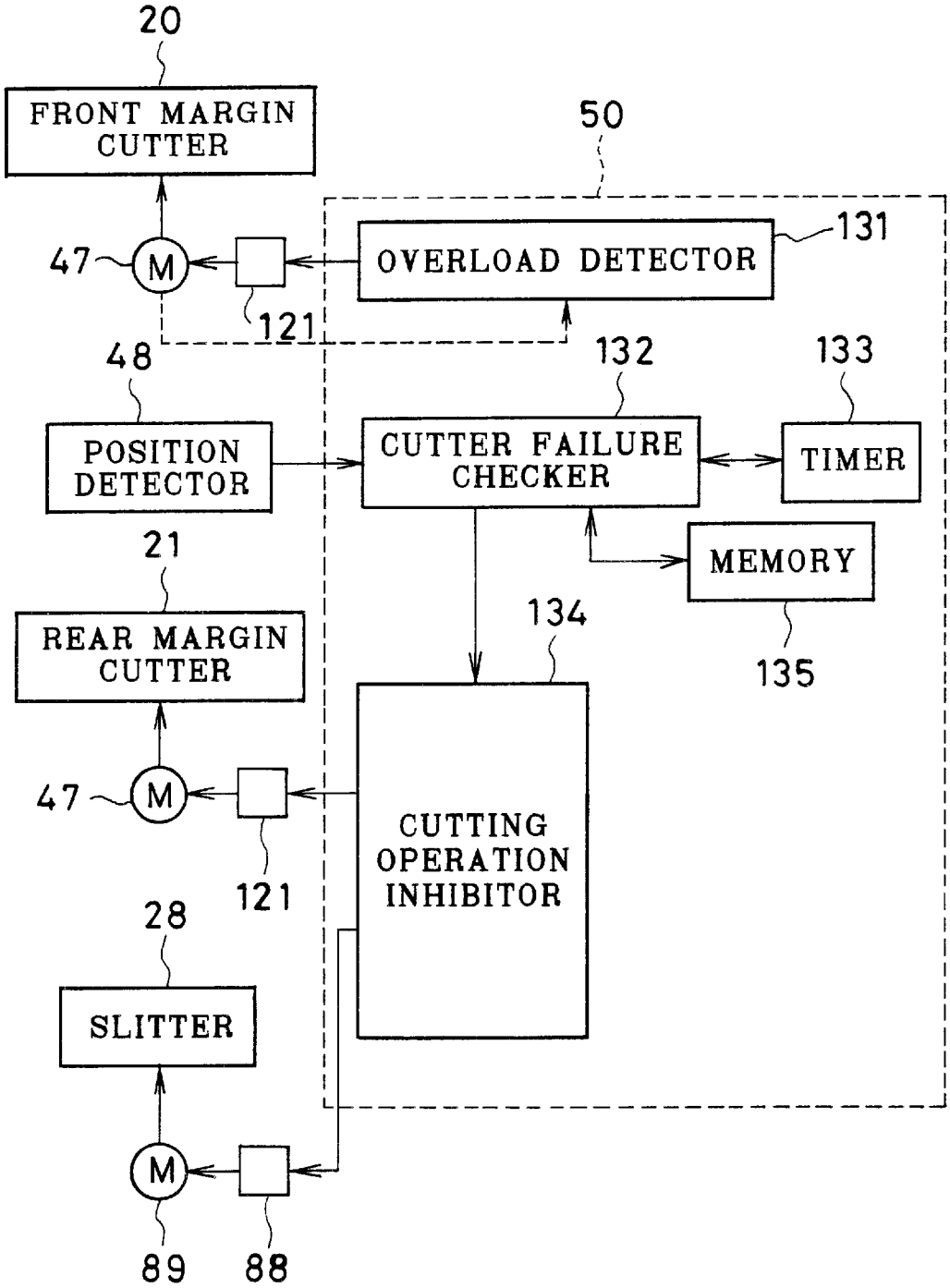
FIG. 10 is a block diagram illustrating a safety circuit for preventing accidents in the cutting operation.

In FIG. 10, the safety circuit is constituted by an overload detector 131, cutter failure checker 132, timer 133, and cutting operation inhibitor 134. The overload detector 131 and timer 133 are failure detectors.

When the overload detector 131 detects overload to the cutter motor 47, then the overload detector 131 sends a signal to the motor driver 121 for causing the cutter motor 47 to rotate backwards, to return the blade holder 42 to the home position. The cutter failure checker 132 monitors an output from the position detector 48 for the front margin cutter 20, causes the timer 133 to measure time elapsed after the start of moving the blade holder 42 and until its return to the home position, and compares the measured time with reference time. If the measured time is shorter, the cutter failure checker 132 detects abnormality. If the measured time is equal to the reference time, the cutter failure checker 132 detects normality. Note that the reference time is predetermined according to a normal cutter operation, and stored in a memory 135. The reference time is determined also in consideration of a tolerable range or errors occurring in the back and forth movement of the movable cutter blade 40.

In response to detection of the failure in the cutter failure checker 132, the cutting operation inhibitor 134 moves the second and fourth rotary blades 62 and 63 in the slitter 28 back to the home position. Then the cutting operation inhibitor 134 inhibits the rear margin cutter 21 from operating, and causes ejection of the recording sheet 2. If it is judged that remaining margins of the recording sheet 2 should not be cut in the first operation of margin cutting, further cutting is suppressed. It is possible reliably to avoid jamming of the recording sheet 2 with difficulties in the cutting.

Figure 11:
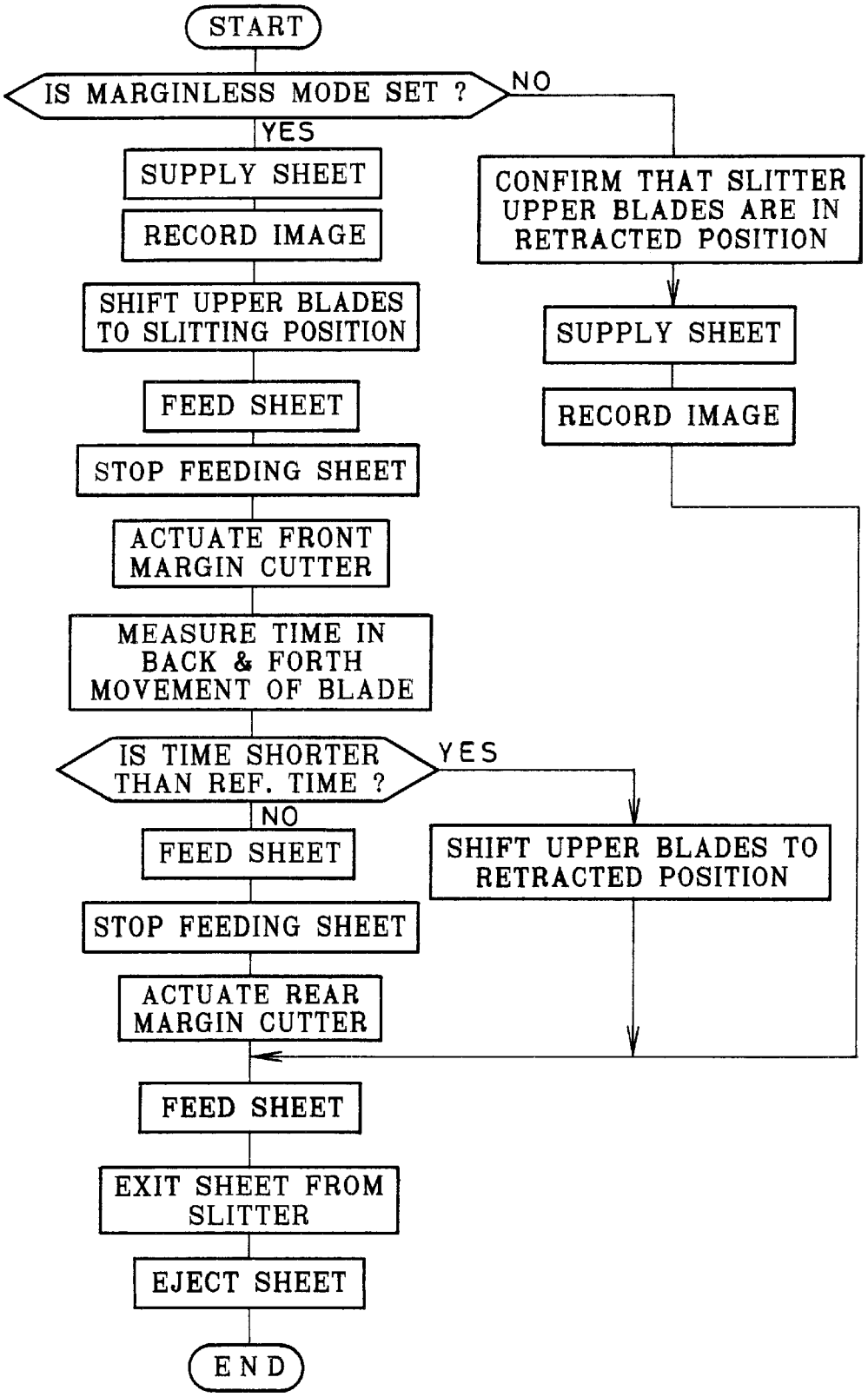
FIG. 11 is a flow chart illustrating operation of the safety circuit.

The operation of the above embodiment is described with reference to FIG. 11. When the printer is in an initialized condition, the thermal head 7 is set in the retracted position away from the platen drum 8. The pinch roller 13 in the sheet feeder 10 is set in the position away from the capstan roller 12. The movable cutter blade 40 in the front and rear margin cutters 20 and 21 is in the home position not to block feeding the recording sheet 2. The second and fourth rotary blades 62 and 63 in the slitter 28 are in the home position away from the recording sheet 2 in the main scan direction.

Before the start of printing, the cutting mode selector switch 87 is operated to input a mode signal for either of the margin mode and marginless mode. After the marginless mode is set by the cutting mode selector switch 87, a printing key (not shown) is operated. The controller 50 effects supply of one of the recording sheet 2 at first. The recording sheet 2 is sent from the sheet supplier 3 toward the thermal head 7. During the feeding, the thermal head 7 is kept shifted away from the platen drum 8.

In FIG. 1, the recording sheet 2 is passed between the thermal head 7 and platen drum 8 with its recording surface directed upwards, and sent to a position between the pinch roller 13 and capstan roller 12 in the sheet feeder 10. When the position sensor 14 detects that a front edge of the recording sheet 2 has passed between the pinch roller 13 and capstan roller 12, then the pinch roller 13 is shifted to a position to press the capstan roller 12. So the pinch roller 13 and capstan roller 12 squeeze the recording sheet 2.

After the squeezing of the sheet feeder 10, the thermal head 7 is shifted to the printing position. Then the stepping motor 11 is driven to rotate the capstan roller 12. The recording sheet 2 is fed in the forward direction.

In the feeding, the controller 50 monitors a sheet feeding amount obtained from the rotary encoder 15. When it is detected that the front edge of the recording region has come to the position of the thermal head 7, then the controller 50 drives the thermal head 7 for recording a yellow image to the recording region one line after another. In the image recording, the yellow fixer lamp 17 in the fixer 16 is turned on to fix the yellow coloring layer photochemically.

After the yellow recording, the thermal head 7 is shifted to the retracted position. Then the recording sheet 2 is fed in the backward direction until the front end of the recording sheet 2 is detected by the position sensor 14. After this, the thermal head 7 is shifted to the printing position. Again, the recording sheet 2 is fed in the forward direction. A magenta image is recorded by the thermal head 7, and also fixed by the magenta fixer lamp 18.

After the magenta recording, a cyan image is recorded. As the cyan coloring layer has so low heat sensitivity as not to be colored in a normally preserved condition. It is also possible to keep the magenta fixer lamp 18 turned on during the cyan recording, to bleach unrecorded regions.

After the cyan recording, a full-color image is formed in a recording region according to the three-color frame-sequential recording. Then the sheet feeder 10 feeds the recording sheet 2 in the backward direction B. The front edge of the recording sheet 2 is moved past the position sensor 14, to end the return of the recording sheet 2.

Then the controller 50 effects a control of setting the second and fourth rotary blades 62 and 63 to the slitting position. At first, the motor driver 88 is caused to drive the shifter motor 89. Rotations of the shifter motor 89 are transmitted to the cam plate 78 by means of a gear train and the like. Thus, the cam plate 78 rotates in one direction. The cam follower pins 74 and 75 inserted in the cam groove 82 are shifted by movement of intersection points between the cam groove 82 and rectilinear guiding slots 76 and 77. Thus, the support brackets 72 and 73 with the cam follower pins 74 and 75 are shifted. This shift is transmitted to the holder plates 69 and 70 and first and second blade support mechanisms 67 and 68.

While the shifter motor 89 is driven, the controller 50 monitors signals from the position sensors 85 and 86. When the position sensor 86 detects the interception plate 84, the controller 50 stops the shifter motor 89. Thus, the first and second blade support mechanisms 67 and 68 are shifted to the slitting position. The second and fourth rotary blades 62 and 63 contact the first and third rotary blades 64 and 65 in directions toward the center of the upper support shaft 53*a*.

The holder plates 69 and 70 are slid by an amount that is slightly greater than an amount of sliding of the second and fourth rotary blades 62 and 63 to contact the first and third rotary blades 64 and 65. In FIG. 9, the support sleeve 100 is pushed and slid to a position slightly away from the stopper flange 104 against the bias of the shock absorbing coil spring 102 after the contact of the second and fourth rotary blades 62 and 63 with the first and third rotary blades 64 and 65. Then the second and fourth rotary blades 62 and 63 are kept pressed on the first and third rotary blades 64 and 65 by the shock absorbing coil spring 102. If dust or unwanted objects come in contact with portions between the rotary blades 62–65, the second and fourth rotary blades 62 and 63 can slide away against the bias of the shock absorbing coil spring 102. Therefore, damages to the rotary blades 62–65 can be avoided. Note that resiliency and biasing force of the shock absorbing coil spring 102 can be determined in consideration of the thickness and material of the recording sheet 2 to be cut. This is effective in raising stability and reliability in the slitting operating.

When setting of the slitter 28 to the slitting position is completed, the recording sheet 2 is fed in the forward direction A. When the front edge of the recording sheet 2 is detected by the position sensor 14, the number of rotations of the pinch roller 13 is counted. When the number comes up to a predetermined value, it is judged that the cutting line 2*a* of the front margin 2*b* in the recording sheet 2 has come to the cutting position in the front margin cutter 20. Then the recording sheet 2 is stopped. The front margin cutter 20 is driven for cutting.

At first, the controller 50 causes the motor driver 121 to rotate the cutter motor 47 forwards and backwards by the predetermined pulse number while the stepping motor 11 is stopped. Then the blade moving belt 44 moves round forwards and then backwards. The blade holder 42 moves back and forth with the blade moving belt 44 between the home position and direction changing position. During the forward movement, the movable cutter blade 40 cuts the recording sheet 2 along the line in the main scan direction.

During the cutter motor 47 is driven, the overload detector 131 in the controller 50 measures a current flowing in the cutter motor 47, and detects overload according to the measured current. If no overload is detected from the cutter motor 47, the cutter motor 47 continues being driven. The cutter failure checker 132 cooperates with the timer 133 to measure time required by the movable cutter blade 40 for one forward and one backward movements according to a signal from the photoelectric sensor 48*b*. The measured time is compared with the reference time to check whether the front margin cutter 20 has properly cut the recording sheet 2. Information of the result of the check is sent to the cutting operation inhibitor 134. The cutting operation inhibitor 134 allows the rear margin cutter 21 to operate upon receiving the information of normality in the cutting.

Note that, at the time of cutting the front margin 2b, the sheet feeder 10 is nipping the recording sheet 2 in the upstream position. In FIG. 3, the sheet guide face 51 and cutting edge 41*a* between which only a small space lies prevent the recording sheet 2 from loosening in the position upstream from the front margin cutter 20. This makes it possible to cut the recording sheet 2 smoothly without wrinkles. Thus, a front edge of the recording region can be cut straight.

When the cutting operation inhibitor 134 allows actuation of the rear margin cutter 21, the controller 50 drives the stepping motor 11, to feed the recording sheet 2 in the forward direction. The front edge of the recording sheet 2 during the feeding becomes nipped by the sheet feeder 29, and is fed by the sheet feeder 29. The sheet feeder 29 rotates at a peripheral speed equal to that of the sheet feeder 10. At the same time as nipping of the sheet feeder 29, the recording sheet 2 starts being slitted by the rotary blades 62–65 in the slitter 28 so that the side margins 33 are removed. When the rear edge of the recording sheet 2 is detected by the edge sensor 22, the cutting line of the rear margin 2*c* in the recording sheet 2 becomes disposed on the cutting position in the rear margin cutter 21. Then the stepping motor 11 is stopped, before the rear margin cutter 21 is actuated.

Note that, at the time of cutting the rear margin 2*c,* the sheet feeder 29 is nipping the recording sheet 2 in the downstream position. In FIG. 4, the sheet guide face 51 and cutting edge 41*a* between which only a small space lies prevent the recording sheet 2 from loosening in the position downstream from the rear margin cutter 21. This makes it possible to cut the recording sheet 2 smoothly without being loose in the cutting position. Thus, a rear edge of the recording region can be cut straight.

After the rear margin cutter 21 is actuated, the stepping motor 11 is driven again to feed the recording sheet 2 in the forward direction A. The front margins 2*b* and 2*c* cut away by the front and rear margin cutters 20 and 21 are dropped by gravity into the dust receptacle 34.

If the movable cutter blade 40 in the front and rear margin cutters 20 and 21 should be disposed on the side of a recording surface of the recording sheet 2, it is likely that there occurs a curl in the recording sheet 2 due to application of heat, and that the movable cutter blade 40 is likely to contact and scratch the recording surface. However, the movable cutter blade 40 in the front and rear margin cutters 20 and 21 is disposed opposite to the recording surface of the recording sheet 2 in the present embodiment. No scratch or harmful contact will take place.

When the recording sheet 2 is fed again by the sheet feeder 29, the rotary blades 62–65 continue cutting away the side margins 33. The shock absorbing coil springs 102 keep the second and fourth rotary blades 62 and 63 pressed on the first and third rotary blades 64 and 65, while the rotary blades 62–65 rotate together with the support shafts 53*a* and 54*a*. So the cutting of the recording sheet 2 can be smooth. The recording sheet 2 after cutting of the side margins 33 is ejected by the sheet feeder 29 from the exit 30 to the sheet receptacle 32.

The side margins 33 cut away by the slitter 28 are guided by the separator plates 90 and 91 and separated from the feeding path. The side margins 33 drop into the dust receptacle 34 and are collected.

Detection of overload by the overload detector 131 is described now. If a current flowing in the cutter motor 47 increases excessively, the increase is detected to judge that there is overload to the cutter motor 47. Upon occurrence of the overload, the overload detector 131 sends a signal to the motor driver 121 for backward rotation of the cutter motor 47. The movable cutter blade 40 is returned to the home position.

The time required by the movable cutter blade 40 for making one forward movement and one backward movement is measured by the cutter failure checker 132 by use of the timer 133. The cutter failure checker 132 compares the measured time with the reference time. When overload is detected, the measured time is shorter than the reference time, because the movable cutter blade 40 is returned to the home position. Then the cutter failure checker 132 detects failure in the cutting. Information of the failure is sent to the cutting operation inhibitor 134. Upon receipt of this, the cutting operation inhibitor 134 controls the shifter motor 89 to retract the second and fourth rotary blades 62 and 63 in the slitter 28, and inhibits the rear margin cutter 21 from operating. The sheet feeder 10 is driven, to cause the sheet feeder 29 to eject the recording sheet 2 for which cutting is discontinued. It is possible to prevent occurrence of jam due to failure in the cutting.

If there is a command signal for producing a plurality of prints and if the marginless mode is set, then the front and rear margin cutters 20 and 21 and slitter 28 are shifted to the home positions before another print is produced. After the three-color frame-sequential recording is effected, the front and rear margin cutters 20 and 21 and slitter 28 are operated to cut away the margins.

If the margin mode is designated by operating the cutting mode selector switch 87, there is no stop of driving the stepping motor 11 after the image recording. The recording sheet 2 is ejected by the sheet feeder 29 from the exit 30. For the recording sheet 2 to pass the slitter 28, the second and fourth rotary blades 62 and 63 and separator plates 90 and 91 are retracted from the recording sheet 2 in the main scan direction. The passage of the recording sheet 2 is not blocked. Also, the first and third rotary blades 64 and 65 have a diameter equal to or slightly smaller than that of the lower feed rollers 54*b*. Even when the recording sheet 2 is passed, scratching of the first and third rotary blades 64 and 65 to the recording surface of the recording sheet 2 can be avoided reliably.

Sizes of each print with or without margins according to the above embodiment can be predetermined as desired. For example, the recording sheet 2 has a postcard size. When margins are cut away, the print has an L size according to the system of silver halide photography. This is effective in that the marginless print can be inserted in an album in the same manner as photographs. If the print has margins without being cut, the print can be used as a postcard.

In the above embodiment, the recording sheet 2 is fed in its longitudinal direction. However, the width direction of the recording sheet 2 may be set as feeding direction or sub scan direction.

In the above embodiment, the recording sheets 2 are single sheets. Alternatively, continuous recording material may be used, and can be unwound from a recording material roll. Furthermore, a printer may have the second and fourth rotary blades 62 and 63 not shiftable in the main scan direction, and the first and third rotary blades 64 and 65 shiftable between the slitting position and home position in the main scan direction. For such a construction, the first and third rotary blades 64 and 65 are located outside the second and fourth rotary blades 62 and 63. In addition, another printer may have the rotary blades 62–65 all shiftable between the slitting position and home position in the main scan direction.

In the above embodiment, the front and rear margin cutters 20 and 21 and slitter 28 are arranged in sequence. The front margin cutter 20 cuts away the front margin 2*b* at first in all the cutting operation. However, the order may be changed. For example, the slitter 28 may be disposed upstream from the front and rear margin cutters 20 and 21, to remove the side margins 33 at first during the cutting operation. The order between the front margin, rear margin and side margins may be changed according to changes in the disposition of the front and rear margin cutters 20 and 21 and slitter 28.

If the slitter 28 is disposed upstream from the front and rear margin cutters 20 and 21, a detector for detecting failure in slitting can be provided at the slitter 28. This slitting failure detector may have a sensor for detecting passage of the recording sheet 2 in a path through the slitter 28. Time required by the recording sheet 2 for passage is measured by a signal obtained by the sensor. It is judged that there is slitting failure if the measured time is more than a predetermined time. Upon the detection of the failure, the cutting operation inhibitor 134 slides the second and fourth rotary blades 62 and 63 to the home position and discontinues the slitting with the slitter. Also, the front and rear margin cutters 20 and 21 are disabled from operating. Note that it is possible to recognize failure in the slitting upon detection of overload in the stepping motor 11.

If the second and fourth rotary blades 62 and 63 are returned to the home position while slitting in the slitter 28 is forcibly stopped, it is likely that the recording sheet 2 is broken as the second and fourth rotary blades 62 and 63 interfere with the recording sheet 2 and margin dust. To prevent such breakage, the recording sheet 2 may be fed in the backward direction B at a predetermined amount, to move the second and fourth rotary blades 62 and 63 to the home position. Furthermore, the rotary blades 62–65 may be stationary blades without rotation or movement. Feeding of the recording sheet 2 may cause the rotary blades 62–65 to slit the recording sheet 2 along slitting lines in the sub scan direction. Such stationary blades may be only upper blades or only lower blades with reference to the feeding path.

In the above embodiment, the movable cutter blade 40 and rotary blades 62–65 have circular shapes. Alternatively, inclined blades with straight cutting edges like a knife may be used. The movable cutter blade 40 may be straight and can be shifted back and forth in a straight manner. The rotary blades 62–65 may be replaced with straight blades that may be also stationary.

In the above embodiment, the front and rear margin cutters 20 and 21 cut the recording sheet 2. However, a printer of the present invention may have only the front margin cutter 20 or only the rear margin cutter 21, which may cut both the front margins 2*b* and 2*c*. Also, when a roll of continuous recording material is used, only either one of the front and rear margin cutters 20 and 21 may be used, because the recording material is cut to obtain each single sheet.

Furthermore, each of the front and rear margin cutters 20 and 21 may be a type different from the above including the movable cutter blade 40, for example a Guillotine type. In this type, a straight movable blade has a cutting edge extending along that of a stationary blade, and moved to the stationary blade crosswise to its extending direction.

In the above embodiment, the movable cutter blade 40 in the front and rear margin cutters 20 and 21 moves back and forth for one cutting operation. However, the movable cutter blade 40 in a cutter may make movement only in one direction for one cutting operation. If a first recording sheet is cut by the movable cutter blade 40 moving in a forward direction, a second recording sheet next to it may be cut by the movable cutter blade 40 moving in a backward direction.

In the above embodiment, the sheet feeder 29 is incorporated in the slitter 28. However, the sheet feeder 29 may be a unit separate from the slitter 28 inside the printer.

In the above embodiment, the feed rollers 53*b* and 54*b* are the two pairs of feed rollers. Alternatively, only one pair of feed rollers may be disposed in the center of the feeder/slitter, including one upper roller and one lower roller.

In the above embodiment, the slitter 28 is a combination of the two slitter mechanisms each of which slits one of the side margins. However, the slitter may have only one slitter mechanism. Only one side margin may be cut away.

In the above embodiment, the cam plate 78 has the cam groove 82. The support brackets 72 and 73 have the cam follower pins 74 and 75. Alternatively, the cam plate 78 may have cam pins. The support brackets 72 and 73 may have cam follower grooves for engagement with the cam pins.

In the above embodiment, the blade moving belt 44 is frictionally engaged with the pulleys 45 and 46. However, the blade moving belt 44 may be a timing belt having teeth. The pulleys 45 and 46 may be gears with which the timing belt is meshed.

Furthermore, the printer in the above embodiment may be provided with a simulation circuit and display panel. When the marginless mode is designated, a simulated image of a print after the margin cutting may be displayed in the display device, for a user to check the simulated image. If he or she does not accept the simulated result, then the image is edited and simulated again. The user rechecks the image. After this, a printer is produced and subjected to cutting.

In the above embodiment, the recording sheets 2 are thermosensitive recording material in which an image is recorded directly by application of heat. Also, thermal transfer recording material may be used, such as ink ribbon or ink sheet. Furthermore, a printer in the present invention may be a monochromatic printer, an ink jet printer, and any type of printer.

Also, a cutting device may be used for any apparatus in which margins of a print with an image frame are cut away, for example a photographic printer, a printer for use with a printing plate, and a cutting device as a single article separate from a printer.

Figure 12:
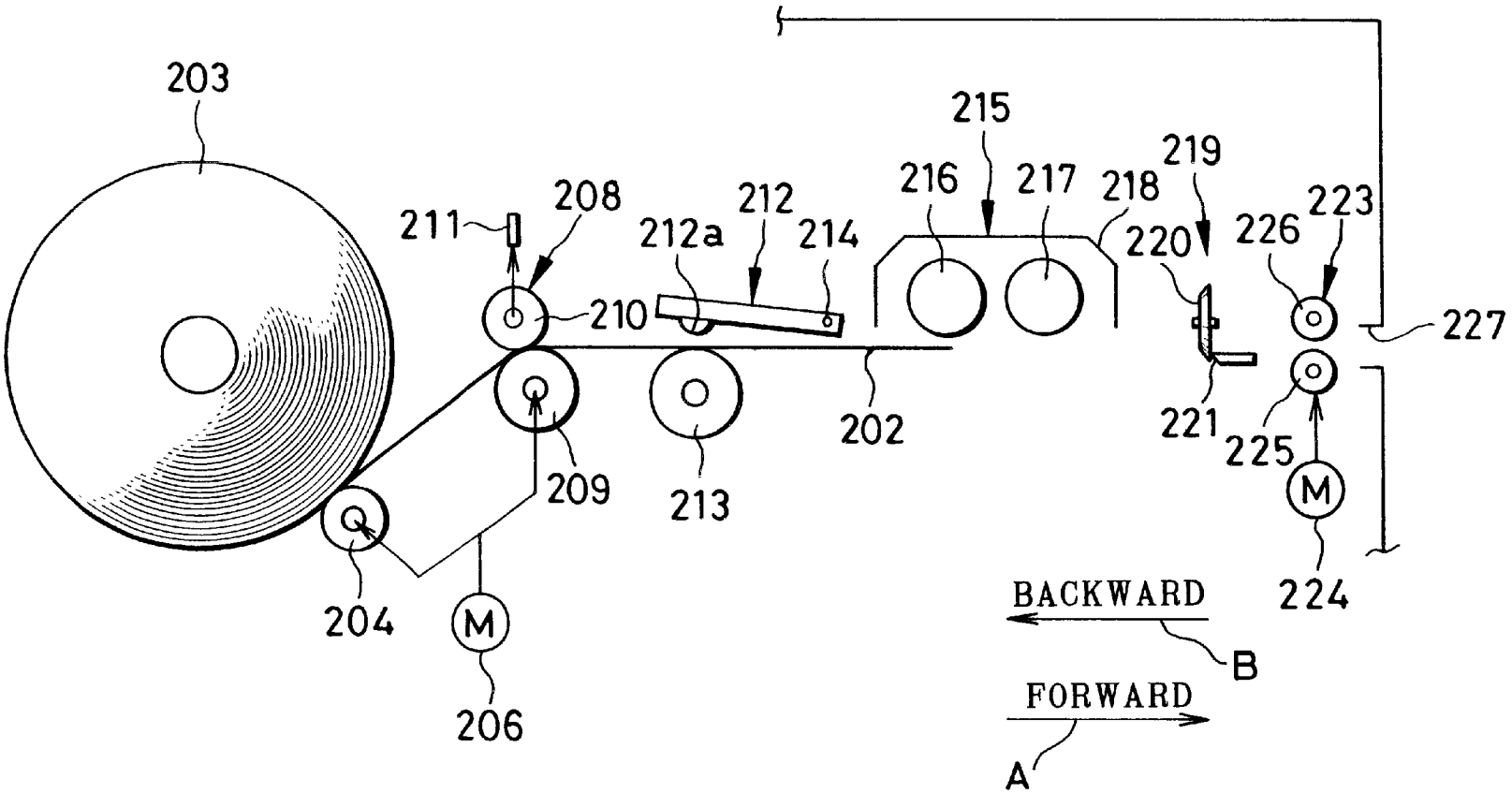
FIG. 12 is an explanatory view in elevation, illustrating another preferred thermal printer.

In FIG. 12, another preferred printer is depicted. Color thermosensitive recording material 202 in a continuous shape is used in the printer. The recording material 202 is wound in a recording material roll 203, which is set in the printer. A supply roller 204 contacts the outermost turn of the recording material roll 203, and is driven by a feeder motor 206. When the supply roller 204 rotates in the clockwise direction, the recording material roll 203 rotates in the counterclockwise direction, to advance the recording material 202 from the recording material roll 203. If the supply roller 204 is rotated in the counterclockwise direction, the recording material roll 203 is rotated clockwise, to wind the recording material 202 back to the recording material roll 203.

When the recording material 202 is fed from the recording material roll 203, the diameter of the recording material roll 203 decreases. However the supply roller 204 is biased by a spring toward the recording material roll 203 to push it.

Thus, the recording material 202 can be fed reliably irrespective of the diameter of the recording material roll 203. Note that the supply roller 204 may lack the shiftable structure. The recording material roll 203 may be supported movably and biased to contact the supply roller 204.

The recording material 202 includes a support, on which cyan, magenta and yellow coloring layers are overlaid as is well-known in the art. The yellow coloring layer is the farthest from the support, and has the highest heat sensitivity. The yellow coloring layer develops the yellow color by application of relatively low heat energy. The cyan coloring layer is the closest to the support, and has the lowest heat sensitivity. The cyan coloring layer develops the cyan color by application of relatively high heat energy. The yellow coloring layer loses its coloring ability when visible violet rays of 420 nm are applied to it. The magenta coloring layer develops the magenta color by application of medium heat energy, and loses its coloring ability when ultraviolet rays of 356 nm are applied to it. Note that it is possible to overlay a black thermosensitive coloring layer on the recording material 202 as a fourth coloring layer. Also, the recording material 202 may be monochromatic only with the black coloring layer.

A recording material feeder 208 is disposed downstream from the supply roller 204. The feeder 208 includes a capstan roller 209 and pinch roller 210. The capstan roller 209 is disposed under the recording material 202, and driven by the feeder motor 206. The pinch roller 210 is pressed on the capstan roller 209. The feeder 208 squeezes the recording material 202 by pressure of the pinch roller 210. The capstan roller 209 rotates to feed the recording material 202 in the forward and backward directions.

A rotary encoder 211 is connected to a rotary shaft of the pinch roller 210. The rotary encoder 211 counts the number of rotations of the pinch roller 210, to measure an amount at which the recording material 202 is fed.

A thermal head 212 and platen drum 213 are disposed downstream from the feeder 208 in the forward direction. The platen drum 213 is rotatable, and has the periphery partially located along a feeding path of the recording material 202. A heating element array 212*a* in the thermal head 212 is opposed to a recording surface of the recording material 202. The thermal head 212 is rotatable about a pivot 214 between a recording position and retracted position, the recording position being where the heating element array 212*a* is pressed on the platen drum 213, the retracted position being where the heating element array 212*a* is away from the platen drum 213. While the recording material 202 is fed in the backward direction, image of the three colors are recorded in the frame-sequential recording.

An optical fixer 215 is disposed downstream from the thermal head 212. The fixer 215 includes a yellow fixer lamp 216, magenta fixer lamp 217, and reflector 218. The yellow fixer lamp 216 emits visible violet rays of which the wavelength peaks at 420 nm. The magenta fixer lamp 217 emits ultraviolet rays of which the wavelength peaks at 365 nm. The fixer lamps 216 and 217 fix respectively the yellow and magenta coloring layers. After the fixation, those coloring layers do not further develop the colors, as the coloring ability is destroyed.

A cutter 219 is disposed downstream from the fixer 215 in the forward direction A, and cuts the recording material 202 along a line in the main scan direction after the image recording, to obtain a print as a sheet.

A recording material feeder 223 is disposed downstream from the cutter 219 in the forward direction A. The feeder 223 includes a capstan roller 225 and a pinch roller 226 that is pressed on the capstan roller 225. A feeder motor 224 drives the capstan roller 225. The feeder 223 nips the recording material 202 and ejects it from the printer through an exit 227.

Figure 13:
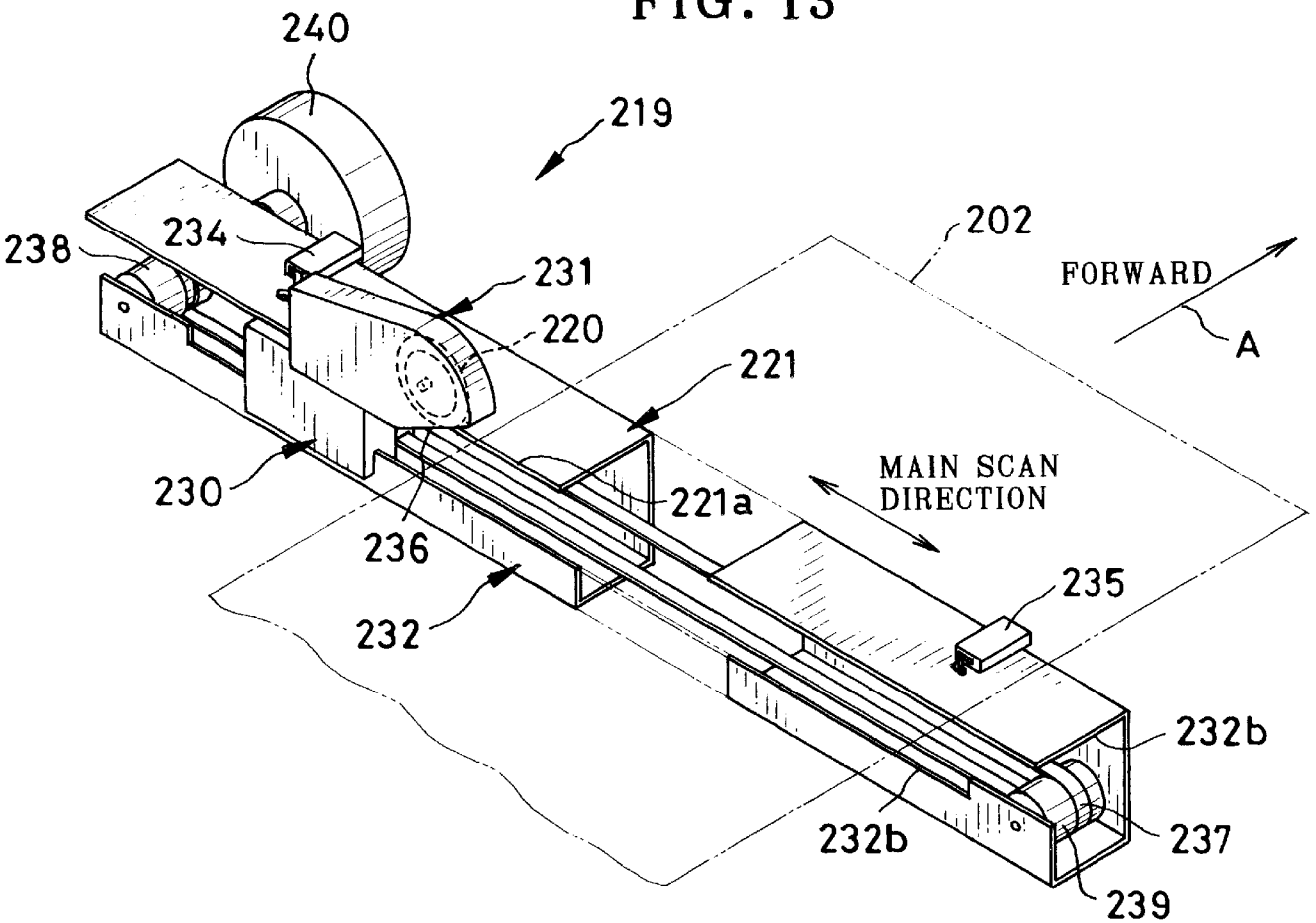
FIG. 13 is a perspective illustrating a margin cutter in the thermal printer.
Figure 14:
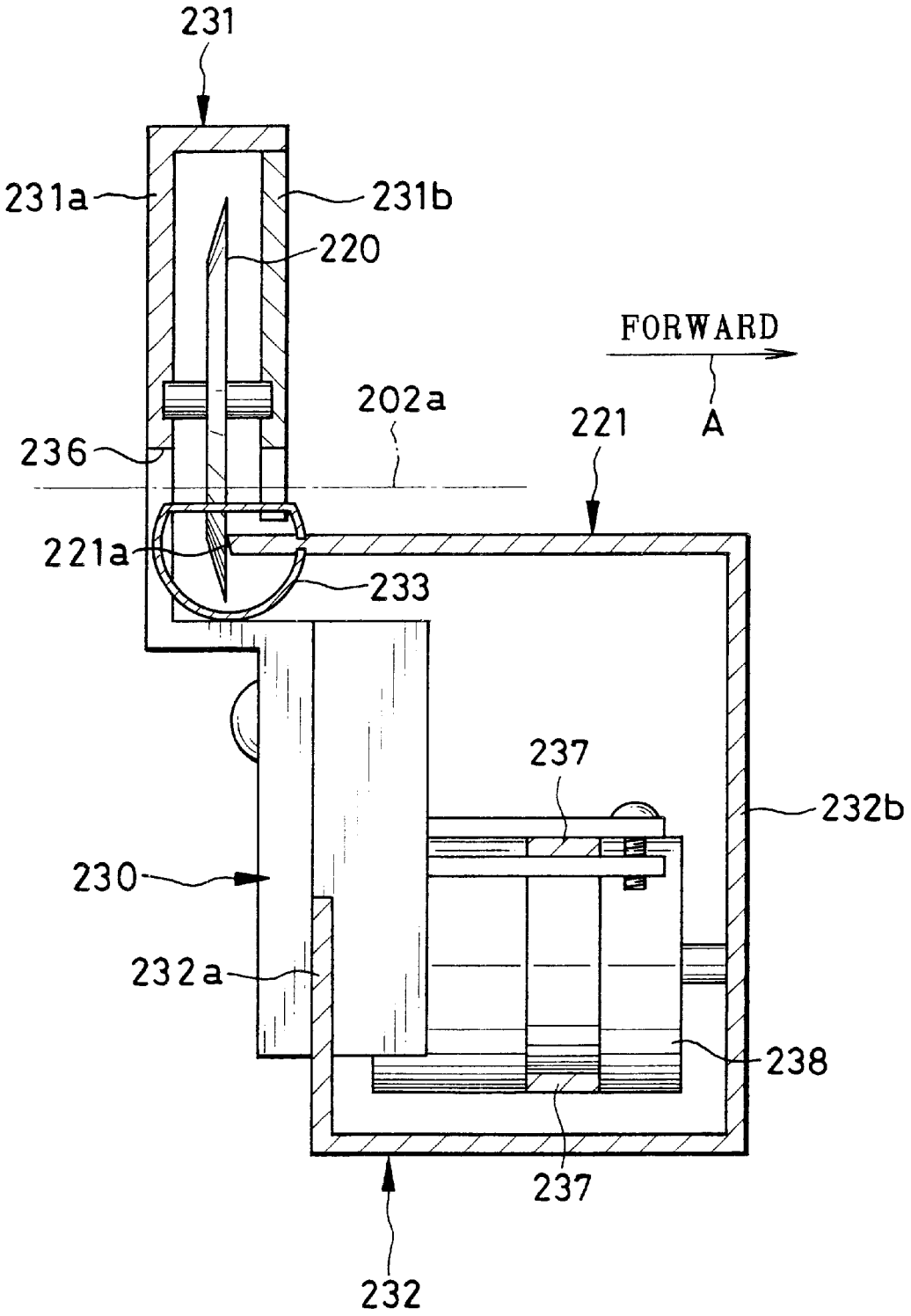
FIG. 14 is a cross section illustrating the thermal printer in which an extensible cover covers a stationary cutter blade.

In FIGS. 13 and 14, the cutter 219 is a combination of elements including a movable cutter blade 220, a stationary cutter blade 221, a blade holder 230, a movable blade protector 231, a blade holder rail 232, a stationary blade protector 233 and holder position detector switches 234 and 235.

The movable cutter blade 220 is opposed to a recording surface of the recording material 202. The stationary cutter blade 221 is opposed to the movable cutter blade 220 with reference to a feeding path 202*a*. The stationary cutter blade 221 extends in the main scan direction, and has a cutting edge 221*a* with a length greater than a size of the recording material 202 in the main scan direction. The stationary cutter blade 221 is so disposed that the cutting edge 221*a* is located slightly lower than the feeding path 202*a*. The movable cutter blade 220 is circular and rotatable, and moves back and forth in the main scan direction of the recording material 202 to cut the recording material 202 with the stationary cutter blade 221.

The stationary cutter blade 221 and blade holder rail 232 are included in one piece formed by bending a metal plate in a channel shape as viewed in section. An upper, horizontally extending portion of the channel-shaped piece is the stationary cutter blade 221. The remaining portion of the channel-shaped piece is the blade holder rail 232. A rail plate 232*a* in the blade holder rail 232 supports the blade holder 230. The blade holder 230 is guided by the rail plate 232*a* and kept movable in the main scan direction of the recording material 202.

The recording material 202 is rotatable in the movable blade protector 231. The movable cutter blade 220 contacts the cutting edge 221*a* in the stationary cutter blade 221. The movable blade protector 231 is constituted by a protector base member 231*a* and protector lid 231*b*, and has a container shape in which only a lower side is open. The blade holder 230 is formed with the protector base member 231*a*. An opening 236 is formed in the movable blade protector 231 for uncovering a portion of the movable cutter blade 220. The opening 236 is opposed to the feeding path 202*a* and directed in the forward direction of movement of the movable cutter blade 220, so that the movable cutter blade 220 is enabled to cut the recording material 202 when moved in the forward direction.

A portion of a blade moving belt 237 is secured to the blade holder 230. A pair of pulleys 238 and 239 support the blade moving belt 237, and are rotatable on sides disposed in the main scan direction of the recording material 202. Each of the pulleys 238 and 239 are supported axially between a cover wall 232*b* of the blade holder rail 232 and the rail plate 232*a* opposed to the cover wall 232*b*. The pulley 238 is driven by a cutter motor 240. The blade moving belt 237 is moved round by the cutter motor 240 in the forward and backward directions. Accordingly, the blade holder 230 is moved back and forth in the main scan direction of the recording material 202. The movable cutter blade 220 is moved between the retracted position and cutting position, the retracted position being where the movable cutter blade 220 is away from the feeding path for the recording material 202, the cutting position being where the movable cutter blade 220 enters the feeding path to cut the recording material 202.

The detector switches 234 and 235 are arranged in the main scan direction of the recording material 202 so that their switch segments are disposed partially in a moving locus of the movable blade protector 231. The detector switches 234 and 235 detect the blade holder 230 in respectively the home position and direction changing position where the blade holder 230 does not block passage of the recording material 202. According to signals generated by the detector switches 234 and 235, the cutter motor 240 is controlled for timing of forward and backward rotations and stop of the rotations.

Figure 15:
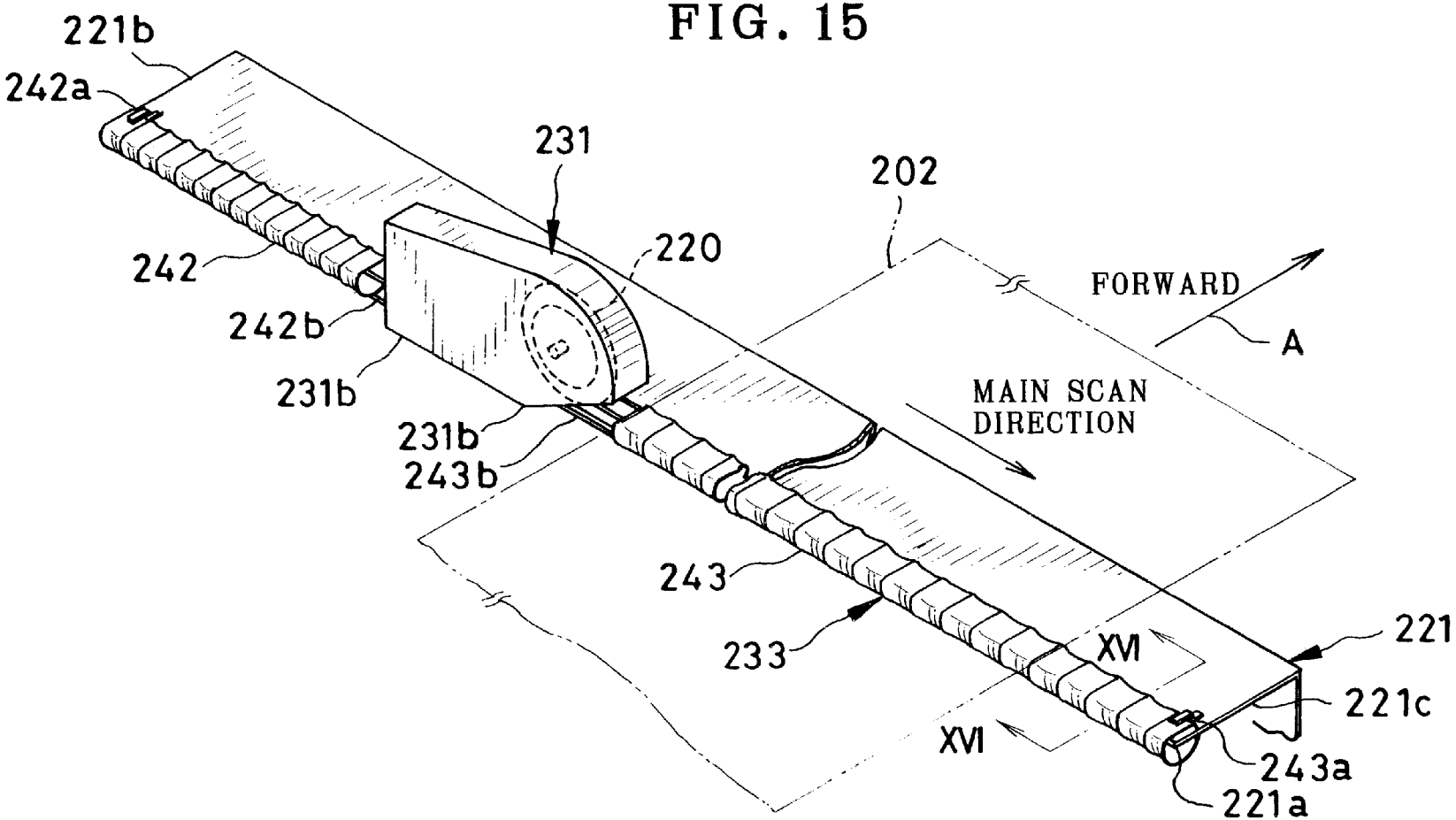
FIG. 15 is a perspective illustrating the extensible cover and the stationary cutter blade.
Figure 16:
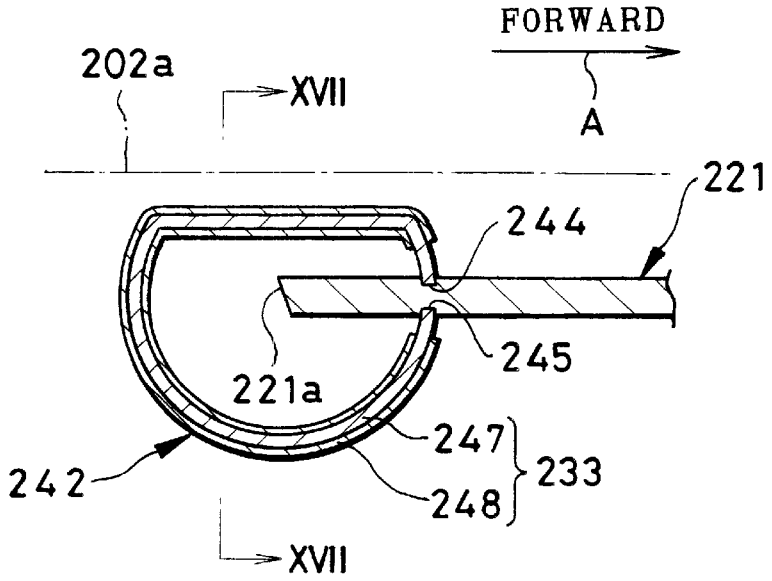
FIG. 16 is a cross section illustrating a cutting edge of the stationary cutter blade with the extensible cover.

In FIGS. 15 and 16, the stationary blade protector 233 is a combination of extensible covers 242 and 243, which are C-shaped as viewed in section to cover the cutting edge 221*a* of the stationary cutter blade 221. The extensible covers 242 and 243 have a flat surface opposed to the feeding path 202*a*. Guide grooves 244 and 245 are formed in the stationary cutter blade 221, and receive two edges of the extensible covers 242 and 243 which lie at the ends of the C-shape. The guide grooves 244 and 245 extend in the main scan direction of the recording material 202, and adapted to guide extension and compression of the extensible covers 242 and 243 in the main scan direction of the recording material 202.

The extensible covers 242 and 243 are positioned by use of securing brackets 242*a*, 242*b*, 243*a* and 243*b*. A first end of the extensible cover 242 is secured by the bracket 242*a* to one end 221*b* of the stationary cutter blade 221. A second end of the extensible cover 242 is secured by the bracket 242*b* to the protector base member 231*a* of the movable blade protector 231. A first end of the extensible cover 243 is secured by the bracket 243*a* to a remaining end 221*c* of the stationary cutter blade 221. A second end of the extensible cover 243 is secured by the bracket 243*b* to the protector lid 231*b* of the movable blade protector 231. Therefore, the extensible cover 243 is extended when the extensible cover 242 is compressed according to the movement of the movable cutter blade 220. The extensible cover 242 is extended when the extensible cover 243 is compressed. The brackets 242*b* and 243*b* secure the extensible covers 242 and 243 to the movable blade protector 231 in positions under the feeding path 202*a* for the purpose of not blocking the recording material 202.

Figure 17:
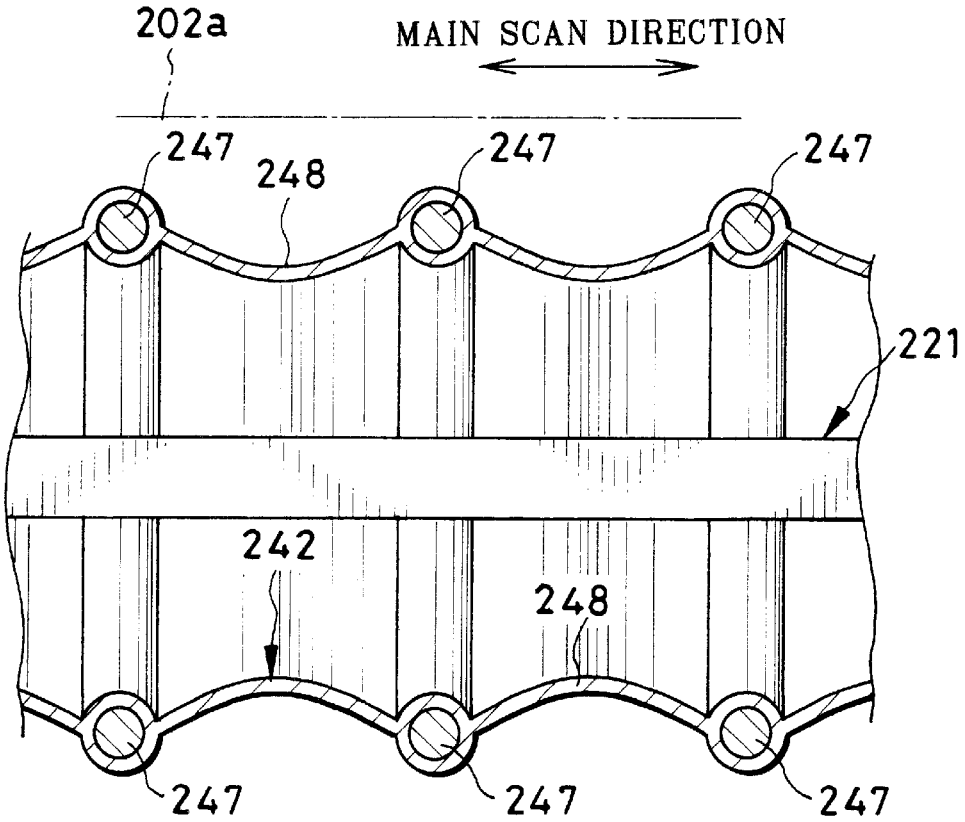
FIG. 17 is a vertical section illustrating the extensible cover with the stationary cutter blade.

In FIG. 17, the extensible covers 242 and 243 include plural protector rings 247 and a flexible sheet 248 for interconnecting the protector rings 247. The protector rings 247 have a C-shape, and has a flat upper end. The guide grooves 244 and 245 receive the two ends of the C-shape of the protector rings 247. The flexible sheet 248 has a bag shape, and connects the protector rings 247 at a predetermined distance. Portions of the flexible sheet 248 are folded to compress the extensible covers 242 and 243.

The operation of the present embodiment is described now. When a printing start signal is input, the feeder motor 206 starts rotation. Rotation of the feeder motor 206 is transmitted to the supply roller 204 and feeder 208. At the time of starting printing, the pinch roller 210 in the feeder 208 is positioned away from the capstan roller 209. The thermal head 212 is set in the retracted position without recording. The pinch roller 226 in the feeder 223 is positioned away from the capstan roller 225, to open the feeding path for the recording material 202.

The supply roller 204 rotates in the clockwise direction, to feed the recording material 202 from the recording material roll 203. The recording material 202 is sent to a position between the capstan roller 209 and pinch roller 210 in the feeder 208. When a sensor (not shown) detects a passage of a front edge of the recording material 202 between the capstan roller 209 and pinch roller 210, the capstan roller 209 is shifted to a position to push the pinch roller 210. The recording material 202 is squeezed by the capstan roller 209 and pinch roller 210. The feeder 208 feeds the recording material 202 to a position between the thermal head 212 and platen drum 213.

The recording material 202 is fed past the thermal head 212 and platen drum 213 and further in the sub scan direction. The rotary encoder 211 measures the feed amount of the recording material 202 according to the number of rotations of the capstan roller 209. When the feed amount comes up to a length corresponding to one sheet, the feeder motor 206 is stopped. Then the thermal head 212 is set in the recording position. The recording material 202 is squeezed by the thermal head 212 and platen drum 213.

Then the feeder motor 206 rotates in the backward direction to rotate the feeder 208 and supply roller 204 in the backward direction. The recording material 202 is fed in the backward direction. When a front end of the recording region comes to the reflector 218, the heating element array 212*a* is driven to record a yellow image to the yellow coloring layer one line after another.

Upon completion of the yellow recording to the recording region in the recording material 202 including the rear edge of the region, the feeder motor 206 is stopped. Then the thermal head 212 is shifted back to the retracted position. Then the feeder motor 206 is rotated in the forward direction again. The supply roller 204 and feeder 208 are rotated to feed the recording material 202 in the forward direction. At the same time as feeding, the yellow fixer lamp 216 in the reflector 218 is turned on to fix the yellow coloring layer in the recording material 202.

When an amount of feeding the recording material 202 comes up to a predetermined amount, the feeder motor 206 is stopped. At the same time, the yellow fixer lamp 216 is turned off. The yellow fixation is completed. Again the thermal head 212 is set in the recording position to squeeze the recording material 202 in cooperation with the platen drum 213. The thermal head 212 is set in the recording position. Then the feeder motor 206 is rotated in the backward direction. The recording material 202 is fed in the backward direction for the second time. In the feeding, a magenta image is thermally recorded. After the thermal recording, the magenta coloring layer is fixed by turning on the magenta fixer lamp 217.

Similarly, a cyan image is thermally recorded. During the cyan recording, the magenta fixer lamp 217 is kept turned on to bleach unrecorded regions. During the bleaching, the recording material 202 is fed in the forward direction. When a cutting line for one sheet reaches a cutting position of the cutter 219, the feeder motor 206 is stopped. The movable cutter blade 220 in the cutter 219 is moved in the main scan direction of the recording material 202 to cut the single sheet from the recording material 202.

When the cutter 219 is in the initial state, the blade holder 230 is set in the home position. The movable cutter blade 220 is in the retracted position. The cutting edge 221*a* in the stationary cutter blade 221 is covered by the stationary blade protector 233. In the stationary blade protector 233, the extensible cover 242 on one side is compressed in a position close to the home position of the blade holder 230. The extensible cover 243 on the remaining side is extended in the direction changing position of the blade holder 230.

To operate the cutter 219, the cutter motor 240 is driven to rotate in the forward direction. The blade moving belt 237 is moved round in one direction. Accordingly, the blade holder 230 moves from the home position to the direction changing position. Also, the extensible cover 242 becomes extended and the extensible cover 243 becomes compressed. Thus, a portion of the stationary cutter blade 221 is uncovered for contacting the movable cutter blade 220 upon movement of the movable cutter blade 220. The recording material 202 can be cut by the movable cutter blade 220 along the line in the main scan direction while the stationary cutter blade 221 is kept covered.

When the movable cutter blade 220 comes to the cutting position, the movable blade protector 231 depresses the detector switch 235. Thus, the cutter motor 240 is stopped. After this, the cutter motor 240 is rotated in the backward direction. The blade holder 230 is slid from the direction changing position to the home position. The movable blade protector 231 depresses the detector switch 234, to stop the cutter motor 240. The movable cutter blade 220 returns to the retracted position to end operation of the cutter 219.

After the cutter 219 is actuated, the feeder motor 224 is driven. The capstan roller 225 rotates to feed the recording material 202 in the forward direction. The recording material 202 becomes ejected through the exit 227. After the ejection, the pinch roller 226 in the feeder 223 is moved away from the capstan roller 225, to end the printing operation.

If one wishes to discontinue printing, the recording material 202 is wound back to the recording material roll 203 and kept in a condition protected from moisture. Therefore, characteristics of the recording material 202 can be kept from changing even with moisture. A color print with good hue can be obtained.

It is to be noted that only the extensible cover 243 may cover a portion of the cutting edge 221*a* of the stationary cutter blade 221 without using the extensible cover 242. When the movable cutter blade 220 is in the retracted position, the cutting edge 221*a* of the stationary cutter blade 221 is entirely covered by the extensible cover 243. Furthermore, the movable blade protector 231 may be stationary, and may be secured in the home position of the movable cutter blade 220, to cover the movable cutter blade 220 only when in the home position.

In the above embodiment, the protector rings 247 and flexible sheet 248 are combined to constitute the extensible covers 242 and 243. However, only the protector rings 247 can constitute an extensible cover without using the flexible sheet 248. For such a structure, linking members can be used for connecting the protector rings 247. The linking members can be provided with such intervals that users' fingers will not enter between those even when the cover is extended.

Figure 18:
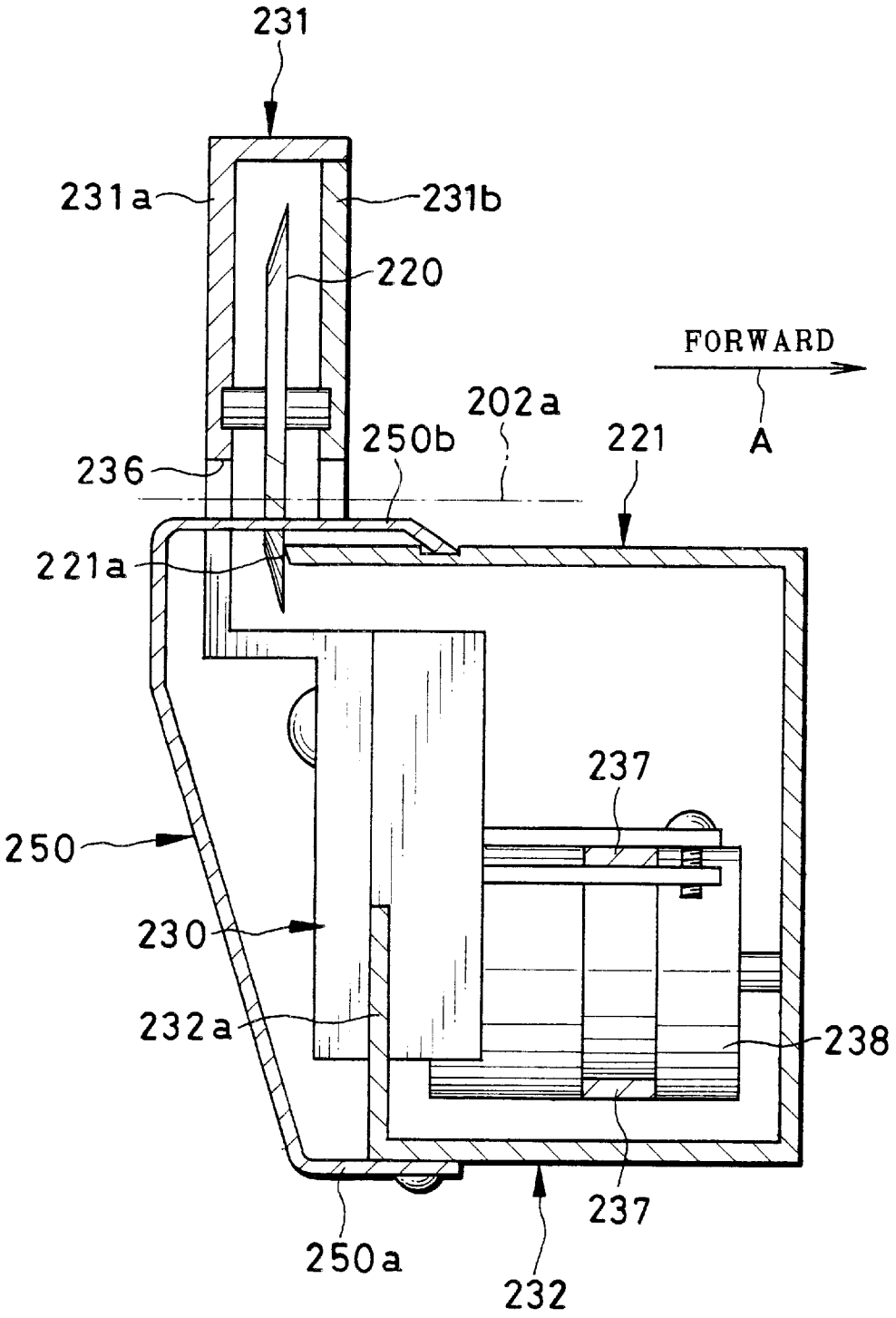
FIG. 18 is a cross section illustrating another preferred thermal printer in which a flexible cover is used to cover the stationary cutter blade.
Figure 19:
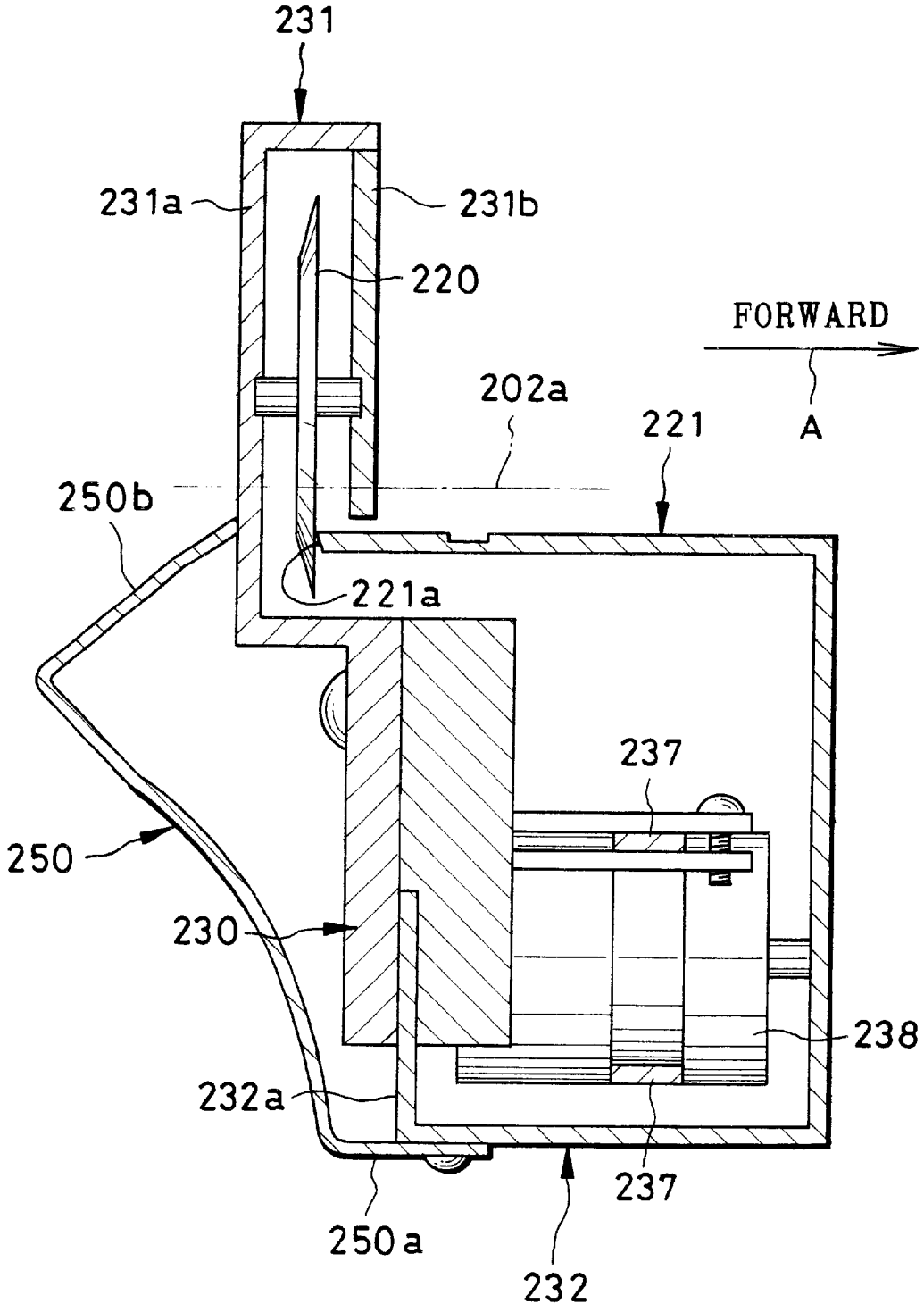
FIG. 19 is a cross section illustrating a state the flexible cover is partially flexed.

In FIGS. 18 and 19, another preferred embodiment is illustrated in which a flexible cover 250 is used instead of the stationary blade protector 233. The flexible cover 250 has an L-shape as viewed in cross section, and extended in the main scan direction of the recording material 202. A lower end 250*a* of the flexible cover 250 is secured to the blade holder rail 232 fixedly. An upper end 250*b* of the flexible cover 250 covers the cutting edge 221*a* by wrapping the top surface of the stationary cutter blade 221 in a position where the movable blade protector 231 is not disposed.

In FIG. 19, a certain portion of the flexible cover 250 is flexed by the movable blade protector 231 to push up the upper end 250*b*. In a position of the movable cutter blade 220, the cutting edge 221*a* of the stationary cutter blade 221 is uncovered in order not to block the recording material 202. When the blade holder 230 slides back and forth, the movable blade protector 231 pushes the flexible cover 250. A pushed portion of the upper end 250*b* of the flexible cover 250 gradually shifts from position to position. At a portion of the stationary cutter blade 221 immediately after passage of the movable blade protector 231, no force is applied to the flexible cover 250. The upper end 250*b* itself returns to the position of blocking the stationary cutter blade 221, to cover the portion of the stationary cutter blade 221. Consequently, this construction is effective in covering the stationary cutter blade 221 even during the cutting operation.

In the above embodiment, the cutter 219 is disposed between the fixer 215 and feeder 223 or ejector. Alternatively, the cutter 219 may be disposed between the supply roller 204 and feeder 208, between the feeder 208 and thermal head 212, or between the feeder/ejector 223 and exit 227.

Note that a printer according to the present invention may be a type for use with thermal transfer ink film or ink sheet of yellow, magenta and cyan colors according to the sublimation thermal recording or wax-transfer thermal recording. In this type of printer, no optical fixer is required. Also, the cutting device of the invention may be used for any apparatus in which margins of a print with an image frame are cut away.

In the above embodiment, the recording material roll is directly set in the printer. However, a printer according to the present invention may be a type for use with a recording material magazine loadable with the recording material roll. Such a recording material magazine may have a supply roller driven by the printer. Also, a printer according to the present invention may be for use with recording sheets, which may be moved back and forth in the printing operation. Such a printer may have a front margin cutter, a rear margin cutter and slitters for cutting away side margins.

Figure 20:
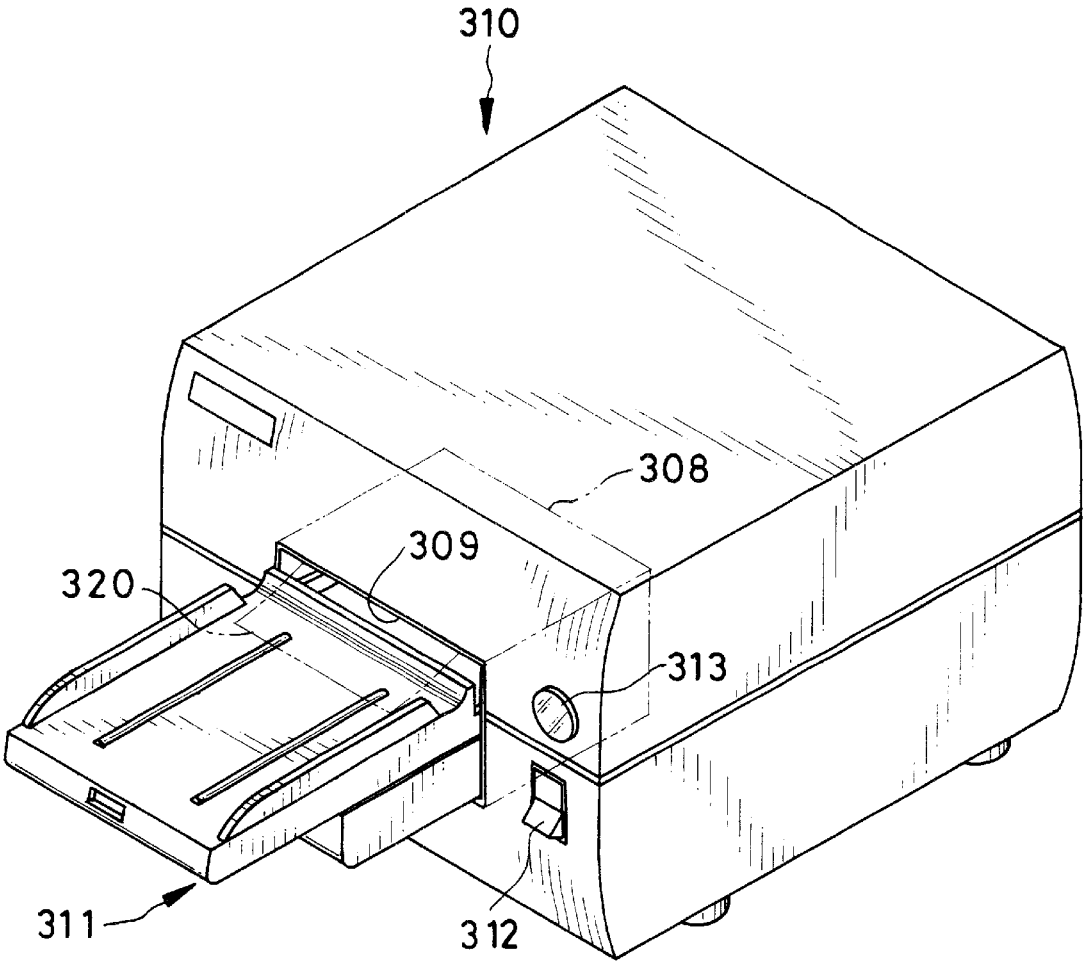
FIG. 20 is a perspective illustrating still another preferred thermal printer.

In FIG. 20, still another preferred thermal printer 310 is illustrated. In a front side, there is a magazine holder chamber 308 which is open at a front opening 309. A sheet supply magazine 311 is removably inserted in the magazine holder chamber 308. A main switch 312 and pilot lamp 313 are also disposed in the front of the thermal printer 310.

Figure 21:
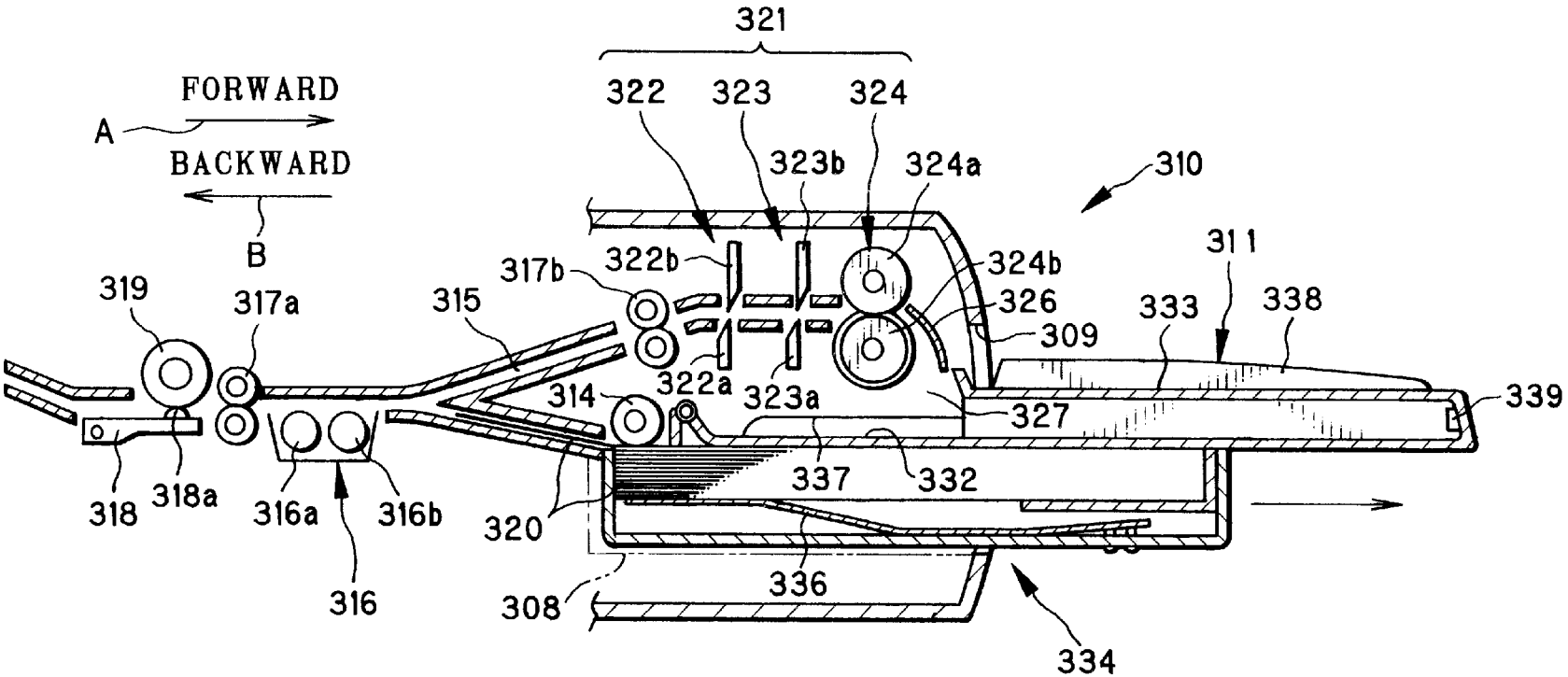
FIG. 21 is a vertical section illustrating the thermal printer.

In FIG. 21, the thermal printer 310 has a three-forked feeding path 315 in which a thermosensitive recording sheet 320 is fed. Along the feeding path 315 are disposed a supply roller 314, an optical fixer 316, pairs of feed rollers 317*a* and 317*b*, a thermal head 318 and a platen drum 319. A cutting device 321 is disposed downstream from the feed rollers 317*b* for cutting away margins of the recording sheet 320.

The thermal head 318 includes heating element array 318*a* extending in the main scan direction, for thermal recording to the recording sheet 320. The recording sheet 320 includes a support, on which cyan, magenta and yellow coloring layers are overlaid as is well-known in the art. The yellow coloring layer loses its coloring ability when visible violet rays of 420 nm are applied to it. The magenta coloring layer loses its coloring ability when ultraviolet rays of 356 nm are applied to it.

The fixer 316 includes a yellow fixer lamp 316*a* and magenta fixer lamp 316*b*. To the recording sheet 320, the yellow fixer lamp 316*a* emits visible violet rays of which the wavelength peaks at 420 nm, and fixes the yellow coloring layer. After the fixation, the coloring ability of the yellow coloring layer is destroyed. The magenta fixer lamp 316*b* emits ultraviolet rays of which the wavelength peaks at 365 nm, and fixes the magenta coloring layer. After the fixation, the coloring ability of the magenta coloring layer is destroyed.

The cutting device 321 is constituted by a front margin cutter 322, a rear margin cutter 323, and a pair of slitter mechanisms 324. The front margin cutter 322 is constituted by a stationary cutter blade 322*a* and movable cutter blade 322*b* extending in the main scan direction. The movable cutter blade 322*b* moves down to cut away the front margin disposed downstream from the recording region in the recording sheet 320. Similarly, the rear margin cutter 323 is constituted by a stationary cutter blade 323*a* and movable cutter blade 323*b,* and cuts away the rear margin disposed upstream from the recording region in the recording sheet 320.

The slitter mechanisms 324 are a rotary type including an upper rotary blade 324*a* and lower rotary blade 324*b*. When the recording sheet 320 is fed in the sub scan direction, the slitter mechanisms 324 cut away side margins from the recording sheet 320 beside its recording region. There are separator plates 326 in the cutting device 321. The separator plates 326 are disposed directly above the sheet supply magazine 311, located in a portion of the slitter mechanisms 324 close to the front opening 309, and guide the side margins or dust toward the sheet supply magazine 311. Note that the slitter mechanisms 324 may be a type different from the rotary type. Also, the cutting device 321 may include either the front and rear margin cutters 322 and 323 or the slitter mechanisms 324, without including the remainder.

The cutting device 321 is connected with the magazine holder chamber 308 under the cutting device 321. Margins cut away by the cutting device 321 drop into the magazine holder chamber 308. If a partition plate is desired between the cutting device 321 and magazine holder chamber 308, an opening is formed in the partition plate.

Figure 22:
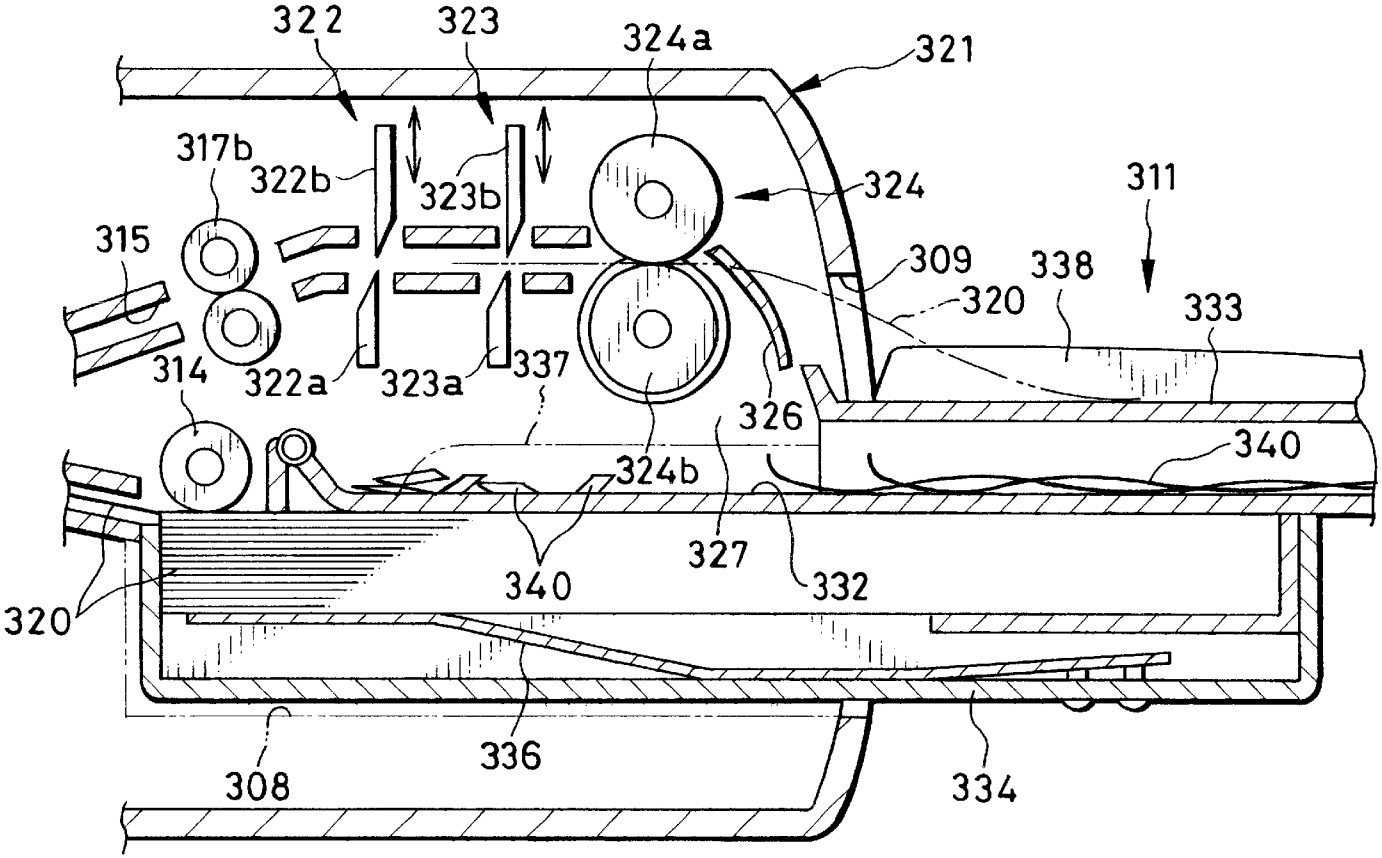
FIG. 22 is a vertical section in enlargement, illustrating a dust receptacle and a sheet container in a sheet supply magazine for the thermal printer.
Figure 23:
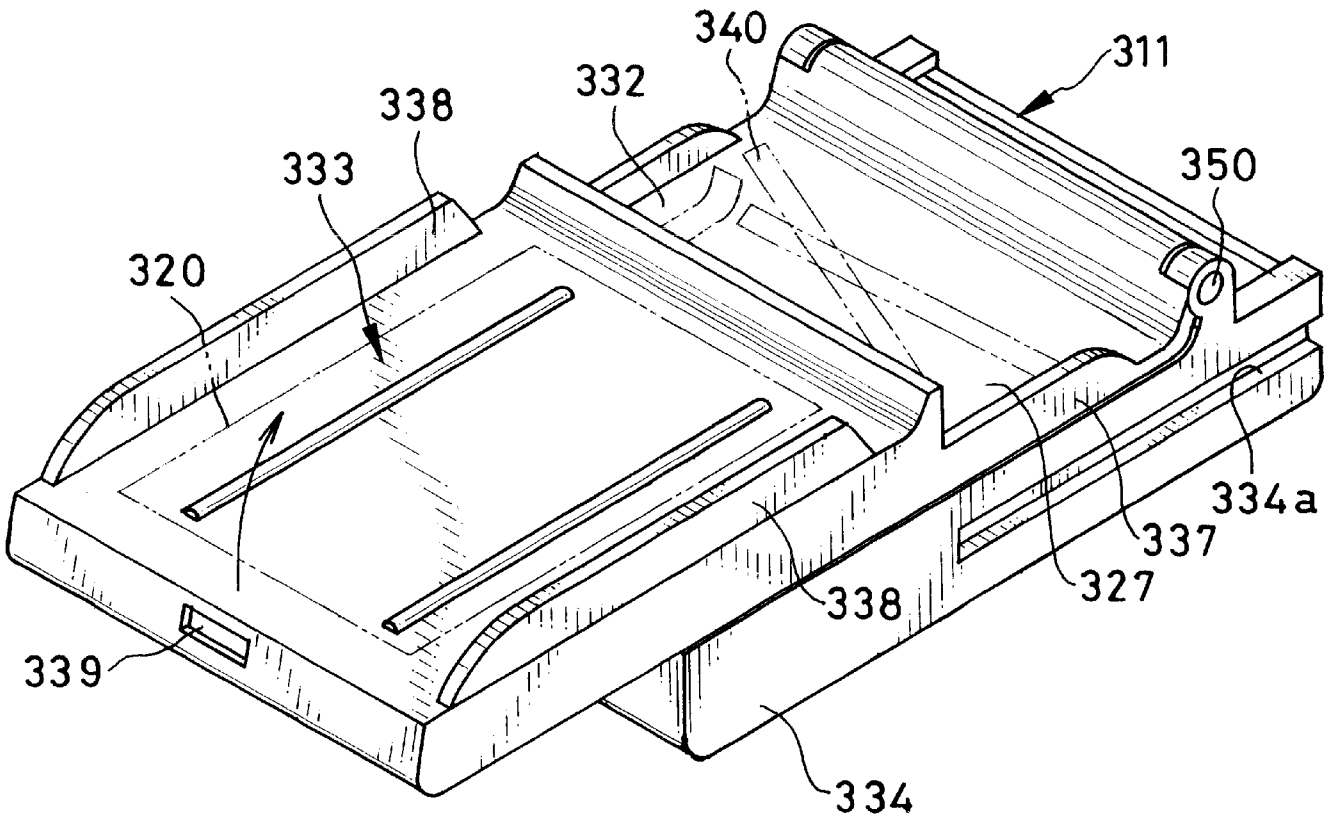
FIG. 23 is a perspective illustrating the sheet supply magazine.

In FIGS. 22 and 23, the sheet supply magazine 311 is mounted in the magazine holder chamber 308 in the thermal printer 310 in a state where nearly a half of the sheet supply magazine 311 is contained in the thermal printer 310. The sheet supply magazine 311 is constituted by a sheet container 334 and dust receptacle 332. A lower wall of the dust receptacle 332 constitutes a lid for the sheet container 334. The plurality of the recording sheets 320 are stacked and contained in the sheet container 334, and are kept pushed up by a lifter 336 with a spring.

The dust receptacle 332 has a box shape, in which margin dust 340 from the cutting device 321 is received. To receive the margin dust 340, a receiving opening 327 is formed in a suitable position. The dust receptacle 332 constitutes a lid of the sheet container 334, as a pivot 350 keeps the dust receptacle 332 rotatable to be open and closed in the top of the sheet container 334. Two guide ridges 337 are formed along sides of the receiving opening 327.

A sheet receptacle 333 is constituted by an upper wall of the dust receptacle 332, and receives the recording sheet 320 ejected from the front opening 309 after margin cutting in the cutting device 321. A pair of guide ridges 338 are formed with the sheet receptacle 333. When the sheet supply magazine 311 is mounted in the thermal printer 310, the sheet receptacle 333 and sheet container 334 are partially protruded from the front opening 309.

A grip recess 339 is formed in an outer wall of the dust receptacle 332. For the supply of the recording sheet 320, the grip recess 339 is grasped manually to turn up the dust receptacle 332 about the pivot 350. The recording sheet 320 is newly inserted by opening the top of the sheet container 334.

In operation, the main switch 312 is turned on at first for a full-color recording in the thermal printer 310. Image data is input to the thermal printer 310 from a personal computer or scanner. A printing starting command is input. The supply roller 314 is rotated to pull an uppermost one of the recording sheets 320 from the sheet container 334. The recording sheet 320 is fed in the direction B in FIG. 21 by advancing its rear edge. After a recording region of the recording sheet 320 is fed by the feed rollers 317*a* in the direction B, the front edge of the recording sheet 320 becomes nipped by the feed rollers 317*a*.

The recording sheet 320 is fed in the forward direction A of FIG. 21 when the front edge becomes nipped by the feed rollers 317*a*. A yellow image is recorded by the thermal head 318 in the recording region in the recording sheet 320. During the yellow recording, the yellow fixer lamp 316*a* is turned on to fix the yellow image. The recording sheet 320 is fed toward the cutting device 321 through the three-forked portion of the feeding path 315. Note that there is a changeover mechanism (not shown) for changing over the feeding path.

When the yellow recording is completed, the recording sheet 320 is returned to the printing starting position. In a manner similar to the yellow recording, a magenta image is thermally recorded and also fixed by the magenta fixer lamp 316*b*. After the magenta recording, a cyan image is recorded. During the cyan recording, the magenta fixer lamp 316*b* is kept turned on to bleach unrecorded portions.

After the three-color frame-sequential recording, the feed rollers 317*b* are rotated continuously to feed the rear edge of the recording sheet 320. A first one of the feed rollers 317*b* comes closer to the remaining one to nip the recording sheet 320 after recording, so the front edge is fed toward the cutting device 321.

For the margin cutting operation, the recording sheet 320 is stopped upon the reach of a front cutting line of the recording sheet 320 to the front margin cutter 322. The movable cutter blade 322*b* moves down to cut away the front margin disposed forwards from the recording region. Then the recording sheet 320 is fed again. When a rear cutting line of the recording sheet 320 reaches the rear margin cutter 323, the recording sheet 320 is stopped again. The movable cutter blade 323*b* moves down to cut away the rear margin disposed backwards from the recording region. Note that the printer may include only one of the front and rear margin cutters 322 and 323 without the remainder, for cutting both front and rear margins.

The margin dust 340 or front and rear margins removed by the front and rear margin cutters 322 and 323 are passed through the receiving opening 327, to enter the dust receptacle 332. The recording sheet 320 fed again after the front margin cutting is moved to the slitter mechanisms 324, which cut away side margins gradually along slitting lines in the sub scan direction toward the rear edge. Side margins are bent by the separator plates 326 downwards, passed through the receiving opening 327 as the margin dust 340, to enter the dust receptacle 332. The margin dust 340 collected in the dust receptacle 332 is prevented by the guide ridges 337 from dropping laterally.

After cutting away all the margins, the recording sheet 320 is ejected from the top of the front opening 309 to the sheet receptacle 333. This is the end of the entire operation of the full-color recording of one print.

When all the recording sheets 320 are used up to empty the sheet container 334, new recording sheets are inserted. At the same time, the margin dust 340 collected in the dust receptacle 332 is discarded. For this operation, the sheet supply magazine 311 is drawn out of the front opening 309 and removed from the thermal printer 310. As the sheet supply magazine 311 has the dust receptacle 332, the margin dust 340 can be removed from the sheet supply magazine 311 in a collected state.

When the dust receptacle 332 with the sheet receptacle 333 is turned up about the pivot 350 by manually grasping the grip recess 339, the margin dust 340 collected in the dust receptacle 332 under the sheet receptacle 333 emerges in the direction to the receiving opening 327. Thus, all the margin dust 340 can be removed without fail. Then new recording sheets 320 are inserted in the sheet container 334 with its top open, before the dust receptacle 332 is turned down to close the sheet container 334.

Although the dust receptacle 332 has the sheet receptacle 333, the printer may be provided with a tray for sheet ejection. Thus, the dust receptacle 332 may lack its upper plate, and may have an upper opening that opens in the entirety of its upper side. The dust receptacle 332 with such a shape has only four or three walls extending vertically.

Note that a printer in the present invention may be a thermal transfer printer, an ink jet printer, a laser printer and any type of printer in which margins are cut away. In the above embodiment, the cutting device cuts away margins along all the four side lines of each print. However, a cutting device of the invention may cut away only at least one of the four margins. Also, a cutting device may operate only for cutting the continuous recording material into separate sheets. Furthermore, edge portions of each print to be cut by the cutting device may be larger or smaller than margins. In case such larger edge portions are cut, the cutting device can operate for trimming the print.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A printer for image printing to a recording material in a region surrounded by front and rear margins and first and second side margins, said front and rear margins extending in a main scan direction, said first and second side margins extending in a sub scan direction, said printer comprising:

cutter means for removing at least one of said front and rear margins from said recording material by cutting along a line extending in said main scan direction;

slitter means for removing at least one of said first and second side margins from said recording material by slitting along a line extending in said sub scan direction;

a slitter shifter for shifting said slitter means in said main scan direction to one of a slitting position and a home position, said slitter means being set in a path of said recording material to cut away said at least one side margin when in said slitting position, and being set away from said path of said recording material when in said home position;

an externally operable mode selector for selectively setting a marginless mode and a margin mode; and a controller for causing said slitter shifter to set said slitter means to said slitting position when said marginless mode is set, and for causing slitting of said slitter means and cutting of said cutter means, said controller causing said slitter shifter to set said slitter means to said home position when said margin mode is set, and inhibiting slitting of said slitter means and cutting of said cutter means.

2. A printer as defined in claim 1, wherein said slitter means is disposed downstream from said cutter means, said slitter means includes first and second slitters for slitting away respectively said first and second side margins, and said cutter means includes a first cutter and a second cutter for cutting away respectively said front and rear margins.

3. A printer as defined in claim 2, wherein said first cutter is disposed upstream from said second cutter, and a space is formed between said first cutter and said second cutter such that said front and rear margins which have been cut away may fall down in said space.

4. A printer as defined in claim 3, further comprising a feed roller pair for feeding said recording material in said sub scan direction; and a motor for rotating said feed roller pair;

said first and second cutters are actuated while said feed roller pair is stopped;

said first and second slitters are stationary in relation to said sub scan direction, and slit said recording material fed by said feed roller pair.

5. A printer as defined in claim 4, wherein said first slitter includes first and second rotary blades, disposed on respective sides of lower and upper surfaces of said recording material, for slitting said recording material by rotating in contacting each other and intersecting each other in a thickness direction of said recording material when said first slitter is set in said slitting position;

said second slitter includes third and fourth rotary blades, disposed on respective sides of lower and upper surfaces of said recording material, for slitting said recording material by rotating in contacting each other and intersecting each other in a thickness direction of said recording material when said second slitter is set in said slitting position.

6. A printer as defined in claim 5, further comprising:

a first shaft extending in said main scan direction, and having said first and third rotary blades secured thereto; and a second shaft extending in said main scan direction, and having said second and fourth rotary blades secured thereto in a slidable manner, said second and fourth rotary blades begin slid along said second shaft by said slitter shifter.

7. A printer as defined in claim 6, wherein a first roller in said feed roller pair is secured to said first shaft, and disposed between said first and third rotary blades, and a second roller in said feed roller pair is secured to said second shaft, and disposed between said second and fourth rotary blades.

8. A printer as defined in claim 7, wherein a cutting edge of said first and third rotary blades has a diameter substantially equal to a diameter of said first roller, and when said margin mode is set, said first and third rotary blades support said recording material without slitting.

9. A printer as defined in claim 8, further comprising:

first and second gears, secured to respectively said first and second shafts, meshed with each other;

a motor for rotating said first and second shafts simultaneously by driving one of said first and second gears.

10. A printer as defined in claim 4, wherein said first and second slitters are disposed downstream from said first and second cutters in said sub scan direction.

11. A printer as defined in claim 10, further comprising an edge sensor, disposed close to said second cutter, for detecting an edge of said rear margin in said recording material;

wherein said controller actuates said first cutter, and while said first and second slitters cut away said side margins, stops said feed roller pair in response to a signal from said edge sensor, actuates said second cutter while said feed roller pair is stopped, and then actuates said feed roller pair to cause said first and second slitters to cut away remainder of said side margins.

12. A printer as defined in claim 4, wherein said first and second cutters include:

first and second stationary cutter blades having a cutting edge extending in said main scan direction;

first and second movable cutter blades having a cutting edge intersecting said cutting edge of said first and second stationary cutter blades in a thickness direction of said recording material; and a blade moving mechanism for moving said first and second movable cutter blades along respectively said first and second stationary cutter blades.

13. A printer as defined in claim 12, wherein said first and second movable cutter blades are circular;

further comprising a blade holder, secured to said blade moving mechanism, for supporting said first and second movable cutter blades in a rotatable manner.

14. A printer as defined in claim 13, further comprising a failure detector for detecting failure in a cutter operation of said first and second cutters;

wherein said controller, when failure in said cutter operation is detected, causes said slitter shifter to keep said first and second slitters in said home position.

15. A printer as defined in claim 14, wherein said blade moving mechanism moves said first and second movable cutter blades from a first position to a second position in said main scan direction, and then moves said first and second movable cutter blades from said second position back to said first position.

16. A printer as defined in claim 15, further comprising a position detector for detecting that said first and second movable cutter blades are in said first position;

wherein said failure detector includes a timer for measuring moving time elapsed after said first and second movable cutter blades start moving from said first position and before said first and second movable cutter blades move back to said first position after movement;

said controller compares said moving time with reference time, and detects occurrence of failure if said moving time is longer than said reference time, said reference time being predetermined according to said cutter operation of said first and second movable cutter blades with normality.

17. A printer as defined in claim 15, wherein said failure detector includes an overload detector for monitoring load applied to said first and second movable cutter blades while said blade moving mechanism moves said first and second movable cutter blades toward said second position, and for detecting overload with said load higher than reference load, said reference load being predetermined according to said cutter operation of said first and second movable cutter blades with normality for said recording material;

when said overload is detected, said controller causes said blade moving mechanism to move said first and second movable cutter blades to said first position.

18. A printer as defined in claim 17, wherein said blade moving mechanism includes a cutter motor, controlled by said controller, for rotating forwards and then backwards, to move said first and second movable cutter blades;

said overload detector monitors load to said cutter motor while said cutter motor rotates forwards;

when said overload is detected, said controller forcibly causes said cutter motor to rotate backwards.

19. A printer as defined in claim 9, wherein said slitter shifter includes:

a shifter motor;

first and second support mechanisms for supporting respectively said second and fourth rotary blades on said second shaft in a slidable manner;

a cam mechanism, shifted by said shifter motor between first and second shifted positions, for driving said first and second support mechanisms, wherein said cam mechanism, when in said first shifted position, shifts said second and fourth rotary blades to said slitting position, and when in said second shifted position, shifts said second and fourth rotary blades to said home position.

20. A printer as defined in claim 19, wherein each of said first and second support mechanisms includes:

a sliding sleeve secured to said second shaft in a slidable manner;

a support sleeve, secured to said second shaft in a slidable manner, for supporting said first or second rotary blade;

a stopper for limiting a range where said sliding sleeve is slidable;

a coil spring, disposed between said sliding sleeve and said support sleeve, for biasing said sliding sleeve to said stopper;

a pin, associated with said second shaft, for receiving said support sleeve biased by said coil spring, to position said first or second rotary blade in said slitting position, said support sleeve being away from said stopper;

a holder plate, disposed between an axial end of said second shaft and said sliding sleeve, slidable with reference to said second shaft, for retaining said sliding sleeve;

a support bracket, secured to said holder plate, and extending substantially along said second shaft;

a cam follower pin, projecting from said support bracket, and driven by said cam mechanism; and a rectilinear guiding mechanism for guiding movement of said cam follower pin in said main scan direction.

21. A printer for image printing to a recording material in a region surrounded by front and rear margins and first and second side margins, said front and rear margins extending in a main scan direction, said first and second side margins extending in a sub scan direction, said printer comprising:

cutter means for removing at least one of said front and rear margins by cutting along a line extending in said main scan direction;

slitter means for removing at least one of said first and second side margins from said recording material by slitting along a line extending in said sub scan direction;

a slitter shifter for shifting said slitter means in said main scan direction to one of a slitting position and a home position, said slitter shifter shifting the slitter means in a linked manner, said slitter means being set in a path of said recording material to cut away said at least one side margin when in said slitting position, and being set away from said path of said recording material when in said home position;

an externally operable mode selector for selectively setting a marginless mode and a margin mode; and a controller for causing said slitter shifter to set said slitter shifter means to said slitting position when said marginless mode is set, and for causing slitting of said slitter means and cutting of said cutter means, said controller causing said slitter shifter to set said slitter means to said home position when said margin mode is set, and inhibiting slitting of said slitter means and cutting of said cutter means.

* * * * *